US009052670B2

(12) United States Patent
Shimura et al.

(10) Patent No.: US 9,052,670 B2
(45) Date of Patent: Jun. 9, 2015

(54) COLOR IMAGE FORMING APPARATUS

(71) Applicant: CANON KABUSHIKI KAISHA, Tokyo (JP)

(72) Inventors: Masaru Shimura, Yokohama (JP); Hideo Nanataki, Yokohama (JP); Shinsuke Kobayashi, Yokohama (JP); Shinji Katagiri, Yokohama (JP); Yasunari Watanabe, Suntou-gun (JP); Hideaki Hasegawa, Suntou-gun (JP); Kiyoto Toyoizumi, Susono (JP); Kouji Yasukawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/451,748

(22) Filed: Aug. 5, 2014

(65) Prior Publication Data

US 2014/0341596 A1 Nov. 20, 2014

Related U.S. Application Data

(63) Continuation of application No. 13/414,188, filed on Mar. 7, 2012, now Pat. No. 8,831,444.

(30) Foreign Application Priority Data

Mar. 11, 2011 (JP) ..... 2011-054472

(51) Int. Cl.

| | |
|---|---|
| ***G03G 15/00*** | (2006.01) |
| ***G03G 15/01*** | (2006.01) |
| ***G03G 15/043*** | (2006.01) |

(52) U.S. Cl.

CPC ..... *G03G 15/553* (2013.01); *G03G 15/011* (2013.01); *G03G 15/043* (2013.01); *G03G 15/55* (2013.01); *G03G 15/5087* (2013.01)

(58) Field of Classification Search

CPC ..... G03G 15/011; G03G 15/043; G03G 15/5087; G03G 15/55; G03G 15/553

USPC ..... 399/26, 32, 177

See application file for complete search history.

(56) References Cited

U.S. PATENT DOCUMENTS

| | | | | |
|---|---|---|---|---|
| 4,961,094 | A * | 10/1990 | Yamaoki et al. | 399/232 |
| 2003/0038872 | A1* | 2/2003 | Ueda et al. | 347/132 |
| 2007/0189785 | A1* | 8/2007 | Nagamochi et al. | 399/26 |
| 2008/0267640 | A1* | 10/2008 | Hamaya et al. | 399/26 |
| 2012/0195604 | A1* | 8/2012 | Kakigi | 399/26 |

FOREIGN PATENT DOCUMENTS

| | | | |
|---|---|---|---|
| JP | H03-089264 | A | 4/1991 |
| JP | H09-109512 | A | 4/1997 |
| JP | 2002-296853 | A | 10/2002 |
| JP | 2003-054040 | A | 2/2003 |
| JP | 2003-287986 | A | 10/2003 |
| JP | 2007-147775 | A | 6/2007 |
| JP | 2011011423 | A * | 1/2011 |

* cited by examiner

*Primary Examiner* — Francis Gray

(74) *Attorney, Agent, or Firm* — Canon USA Inc IP Division

(57) ABSTRACT

In a color image forming apparatus, the amount of light of an exposure unit for a weak exposure is changed according to a remaining service life of a photosensitive drum when the weak exposure is performed for the background area of a corresponding photosensitive drum by using the exposure unit.

12 Claims, 16 Drawing Sheets

FIG. 9A

| NUMBER OF ROTATIONS OF DRUM (X1000) | FINE EXPOSURE | | NORMAL EXPOSURE | | | | LUMINOUS INTENSITY (mW) |
|---|---|---|---|---|---|---|---|
| | | | NORMAL EXPOSURE (DENSITY 0%) | | NORMAL EXPOSURE (DENSITY 100%) | | |
| | μJ/cm² | %(PWM) | μJ/cm² | %(PWM) | μJ/cm² | %(PWM) | |
| 0 ≦ r < 37.5 | 0.030 | 12.0 | 0.030 | 12.0 | 0.25 | 100 | 3.5 |
| 37.5 ≦ r < 75 | 0.038 | 15.0 | 0.038 | 15.0 | 0.25 | 100 | 3.5 |
| 75 ≦ r < 112.5 | 0.045 | 18.0 | 0.045 | 18.0 | 0.25 | 100 | 3.5 |
| 112.5 ≦ r < 150 | 0.053 | 21.0 | 0.053 | 21.0 | 0.25 | 100 | 3.5 |
| 150 ≦ r | 0.060 | 24.0 | 0.060 | 24.0 | 0.25 | 100 | 3.5 |

FIG. 9B

| NUMBER OF ROTATIONS OF DRUM (X1000) | WEAK EXPOSURE | | NORMAL EXPOSURE | | | | LUMINOUS INTENSITY (mW) |
|---|---|---|---|---|---|---|---|
| | | | NORMAL EXPOSURE (DENSITY 0%) | | NORMAL EXPOSURE (DENSITY 100%) | | |
| | μJ/cm² | %(PWM) | μJ/cm² | %(PWM) | μJ/cm² | %(PWM) | |
| 0 ≦ r < 37.5 | 0.030 | 12.0 | 0.030 | 12.0 | 0.25 | 100 | 3.50 |
| 37.5 ≦ r < 75 | 0.038 | 15.5 | 0.038 | 15.5 | 0.30 | 100 | 4.24 |
| 75 ≦ r < 112.5 | 0.045 | 19.0 | 0.045 | 19.0 | 0.36 | 100 | 4.97 |
| 112.5 ≦ r < 150 | 0.053 | 22.6 | 0.053 | 22.6 | 0.41 | 100 | 5.71 |
| 150 ≦ r | 0.120 | 26.1 | 0.120 | 26.1 | 0.46 | 100 | 6.44 |

| NUMBER OF ROTATIONS OF DRUM x 1000 | STRUCTURE | | |
|---|---|---|---|
| | COMPARATIVE EXAMPLE 1 | COMPARATIVE EXAMPLE 2 | FIRST EXEMPLARY EMBODIMENT |
| 0 | ○ | ○ | ○ |
| 30 | ○ | ○ | ○ |
| 60 | ○ | ○ | ○ |
| 90 | ○ | △ | ○ |
| 120 | ○ | △ | ○ |
| 150 | ○ | × | ○ |

FIG. 12

| NUMBER OF ROTATIONS OF DRUM (X1000) | WEAK EXPOSURE | | NORMAL EXPOSURE | | | | LUMINOUS INTENSITY (mW) (SUMMED LUMINOUS INTENSITY) |
|---|---|---|---|---|---|---|---|
| | | | NORMAL EXPOSURE (DENSITY 100%) | | NORMAL EXPOSURE (DENSITY 100%) | | |
| | μJ/cm² | LUMINOUS INTENSITY (mW) | μJ/cm² | %(PWM) | μJ/cm² | %(PWM) | |
| 0 ≦ r < 37.5 | 0.030 | 0.42 | 0 | 0 | 0.25 | 100 | 3.50(3.08) |
| 37.5 ≦ r < 75 | 0.038 | 0.66 | 0 | 0 | 0.30 | 100 | 4.24(3.58) |
| 75 ≦ r < 112.5 | 0.045 | 0.95 | 0 | 0 | 0.36 | 100 | 4.97(4.02) |
| 112.5 ≦ r < 150 | 0.053 | 1.29 | 0 | 0 | 0.41 | 100 | 5.71(4.42) |
| 150 ≦ r | 0.120 | 1.68 | 0 | 0 | 0.46 | 100 | 6.44(4.76) |

COLOR IMAGE FORMING APPARATUS

CROSS REFERENCE TO RELATED APPLICATIONS

The present application is a continuation of U.S. patent application Ser. No. 13/414,188, filed on Mar. 7, 2012, the content of which is expressly incorporated by reference herein in its entirety. This application also claims the benefit of Japanese Patent Application No. 2011-054472 filed Mar. 11, 2011, which is hereby incorporated by reference herein in its entirety.

BACKGROUND OF THE INVENTION

1. Field of the Invention

The present invention relates to a color image forming apparatus employing electrophotographic recording method, such as a laser printer, a copying machine, a facsimile.

2. Description of the Related Art

Conventionally, an image forming apparatus employing an electrophotographic recording method such as a copying machine, a laser printer has been well known. For such an image forming apparatus, reducing manufacturing cost and reducing the size of the apparatus have been demanded. Under such circumstances, for example, Japanese Patent Application Laid-Open No. 11-102145 has proposed a monochrome printer in which a voltage is applied to both its developing units and its charging units from a single common high-voltage power supply in order to reduce the size of the apparatus.

SUMMARY OF THE INVENTION

The present invention is directed to a color image forming apparatus capable of solving the problem occurred when a power source is used common for developing units and charging units as discussed in Japanese Patent Application Laid-Open No. 11-102145. More specifically, in a color image forming apparatus including, for each of a plurality of colors, photosensitive members, charging units, light beam emission units for forming electrostatic latent images on the photosensitive members by emitting light beams thereto, and developing units for visualizing toner images by applying toners to the electrostatic latent images, when the potential of each photosensitive member is difficult to be optimal after the charging, because a single power source for each charging member corresponding to each photosensitive member is used common therein for reducing cost and downsizing, the potential of each photosensitive member after charging is optimized by performing small amount exposure at a background portion where a toner image is not to be visualized on the photosensitive member after charging. Further, the purpose of the present invention is to optimize the potential of each photosensitive drum after charging based on the above described configuration to adapt to various photosensitive characteristics of the drums (EV characteristic).

According to an aspect of the present invention, a color image forming apparatus including photosensitive members, charging units configured to charge the photosensitive members, light beam emission units configured to form an electrostatic latent image on the photosensitive member charged by being irradiated with light beam, and developing units configured to visualize a toner image by applying toner to the electrostatic latent image, corresponding to a plurality of colors, respectively, includes an acquisition unit configured to acquire information concerning a remaining service life of each of the plurality of photosensitive members corresponding to the plurality of colors, and a control unit configured to cause each of the plurality of the light beam emission units to execute normal light beam emission for visualizing the toner image onto an area where the toner image is to be visualized on the charged photosensitive member, and cause the plurality of light beam emission units to execute weak light beam emission onto a background area where the toner image is not to be visualized on the charged photosensitive member, wherein at least so as to reduce variability of surface potential on the background area of each of the plurality of charged photosensitive members, the control unit changes the amount of light of each of the plurality of the light beam emission units based on information concerning the remaining service life of each of the photosensitive member acquired by the acquisition unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 9A and 9B are a table illustrating a relation between photosensitive drum usage conditions and weak exposure parameters, and a table illustrating a relation between photosensitive drum usage conditions and normal exposure parameters.

FIG. 12 is a table illustrating a relationship between other photosensitive drum usage conditions and weak exposure parameters, and a table indicating a relation between another photosensitive drum usage conditions and normal exposure parameters.

DESCRIPTION OF THE EMBODIMENTS

Various exemplary embodiments, features, and aspects of the invention will be described in detail below with reference to the drawings. The components described in this exemplary embodiment are just examples of the present invention and the scope of the present invention is not limited to only those components.

First, a configuration of a color image forming apparatus (hereinbelow, referred to as an image forming apparatus) will be described with reference to FIGS. 1 to 5A, 5B, and a control operation for a weak exposure will be described with reference to FIGS. 6 to 9A, 9B. Finally, an effect of the fogging amount and the image uniformity will be described with reference to FIGS. 10A and 10B.

Figure 1:
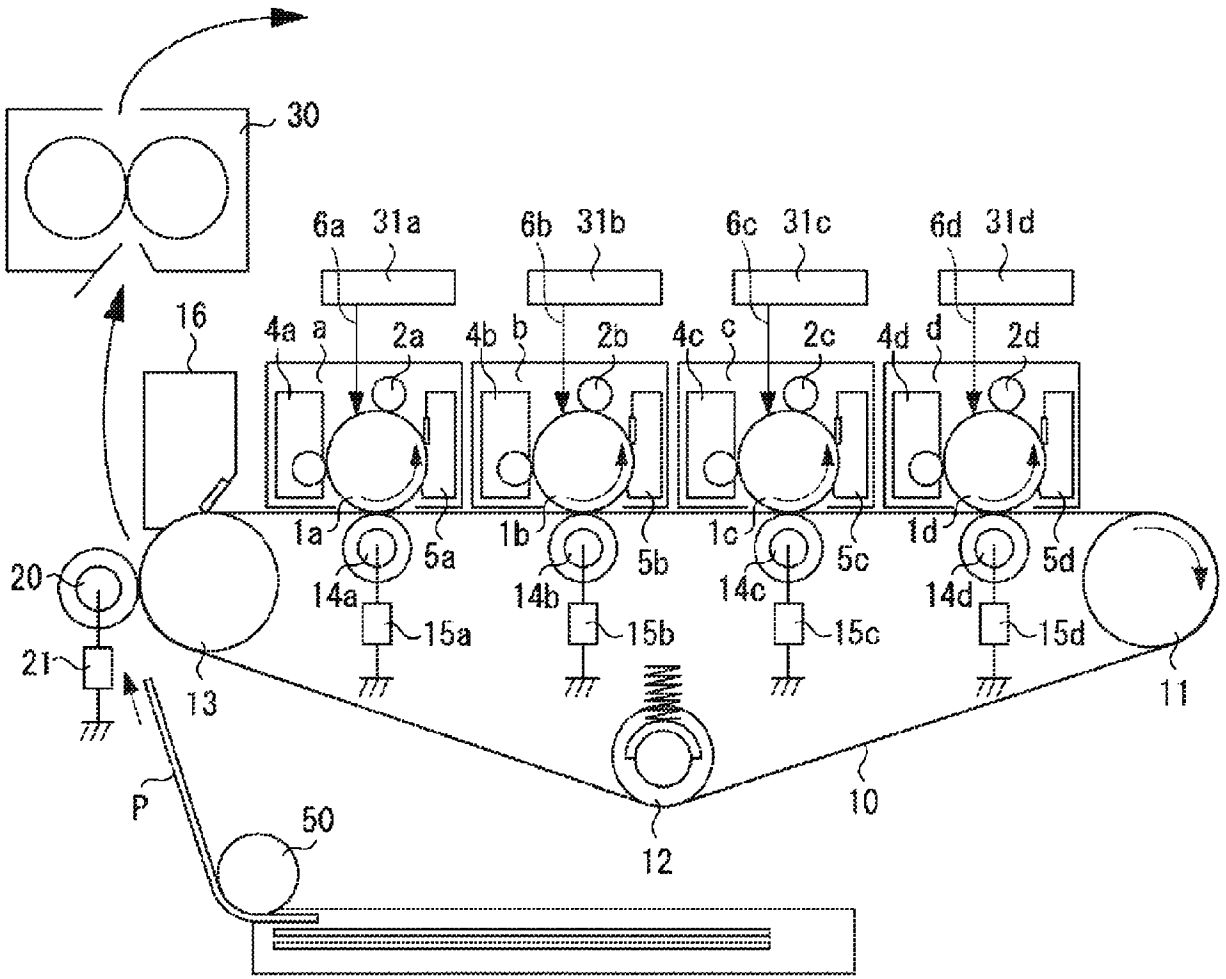
FIG. 1 is a cross-sectional diagram illustrating schematically a color image forming apparatus.

FIG. 1 is a cross-sectional diagram illustrating schematically an image forming apparatus. The configuration and operation of the image forming apparatus of the present exemplary embodiment will be described with reference to FIG. 1.

The image forming apparatus includes first to fourth (a to d) image forming stations. The first station is for yellow (hereinafter referred to as Y), the second station is for magenta (hereinafter referred to as M), the third station is for cyan (hereinafter referred to as C), and the fourth station is for black (hereinafter referred to as Bk).

Each of the stations "a" to "d" has a storage member (memory tag) which stores an integrated number of rotations of a photosensitive drum 11*a* as information concerning the service life of the photosensitive drum. Additionally, each station can be replaced with respect to the image forming apparatus main body.

Each station is required to contain at least a photosensitive drum, and which components should be included in the image forming station to be replaceable is not limited to any particular example. An operation of the first image forming station (Y) a will be described as a representative of the stations below.

The image forming station includes a photosensitive drum 1*a* as a photosensitive member and this photosensitive drum 1*a* is rotated in a direction indicated with an arrow at a predetermined circumferential velocity (process speed). In this rotation process, the photosensitive drum 1*a* is charged with a charging potential having a predetermined polarity by a charging roller 2*a*. Next, by scanning with laser beam 6*a* from an exposure unit 31*a* based on image data (image signal) supplied from outside, the surface of the photosensitive drum 1*a* which serves as an image forming unit is exposed to eliminate electric charge, so that an exposure potential V1 is formed on the surface of the photosensitive drum 1*a*.

Next, toner is developed on an exposure potential V1 unit serving as the image forming unit according to a difference in potential between a developing voltage Vdc and an exposure potential V1, and the toner image is visualized. The image forming apparatus according to the present exemplary embodiment is a reversal developing type apparatus which executes image exposure with the exposure unit 31*a* and develops the toner image on the exposure unit.

An intermediate transfer belt 10 is stretched around by tension members 11, 12, 13 and keeps contact with the photosensitive drum 1*a*. This intermediate transfer belt 10 is driven at the contact positions in the same direction as the photosensitive drum 1*a* at a substantially same circumferential velocity.

When the yellow toner image formed on the photosensitive drum 1*a* passes through a contact portion (hereinafter referred to as primary transfer nip) formed between the photosensitive drum 1*a* and the intermediate transfer belt 10, the yellow toner image is transferred onto the intermediate transfer belt 10 with a primary transfer voltage applied to a primary transfer roller 14*a* (primary transfer).

Primary transfer residual toner remaining on the surface of the photosensitive drum 1*a* is swept and removed by a cleaning unit 5*a* and after that, the above-described image forming process subsequent to the charging is repeated.

After that, a magenta toner image (M) is formed as a second color, a cyan toner image (C) is formed as a third color and then, a black toner image (Bk) is formed as a fourth color. These toner images are transferred onto the intermediate transfer belt 10 in sequence so that one color overlaps another color, thereby a combined color image being obtained.

When the four toner images on the intermediate transfer belt 10 pass through the contact portion (hereinafter referred to as secondary transfer nip) formed between the intermediate transfer belt 10 and the secondary transfer roller 20, the four toner images are transferred collectively onto the surface of a recording material P supplied by a feeding unit 50 with a secondary transfer voltage applied to the secondary transfer roller 20 by a secondary transfer power supply 21. After that, the recording material P carrying the four toner images is introduced into a fixing device 30, and heated and pressurized there, so that the four toners are melted and mixed, and fixed to the recording material P.

Through the above-described operation, a full-color toner image is formed on the recording material. The secondary transfer residual toner remaining on the surface of the intermediate transfer belt 10 is swept and removed by an intermediate transfer belt cleaning unit 16.

Although the present exemplary embodiment has been described with reference to FIG. 1 by taking the image forming apparatus having the intermediate transfer belt 10 as an example, the present invention is not limited thereto. For example, the present exemplary embodiment may be carried out in the image forming apparatus based on a method in which a recording material carrying belt (recording material bearing member) is provided and a toner image developed by the photosensitive drum is transferred directly to the recording material carried by the recording material carrying belt.

Hereinafter, the image forming apparatus having the intermediate transfer belt 10 will be described below.

Figure 2:
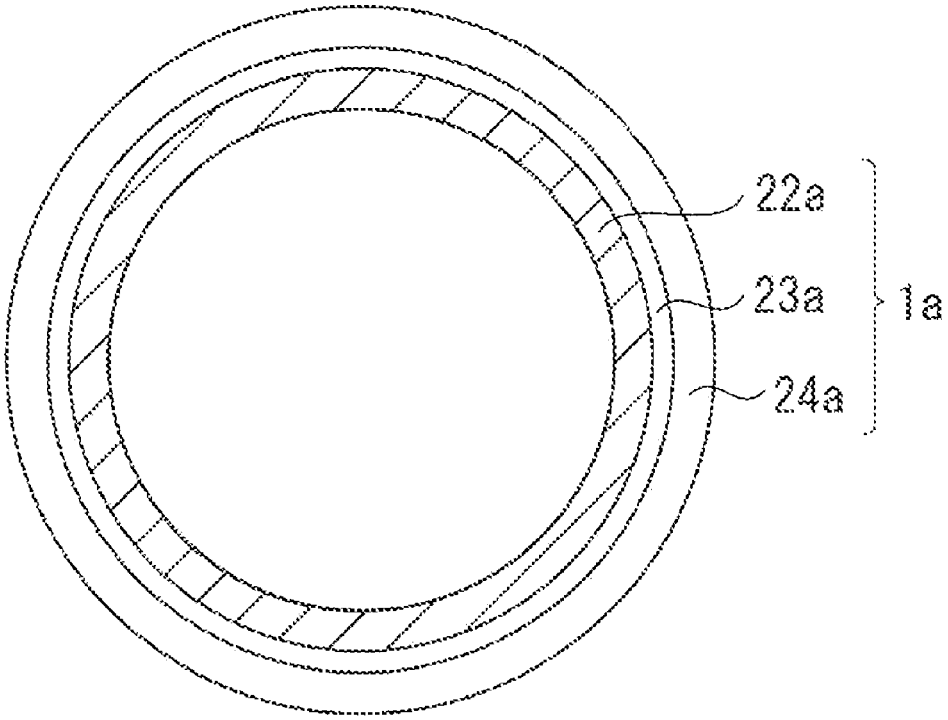
FIG. 2 is a cross-sectional diagram illustrating a photosensitive drum.

FIG. 2 illustrates an example cross-section of the photosensitive drum 1*a*. The photosensitive drum 1*a* includes a charge generation layer 23*a* and a charge transport layer 24*a* laminated on a conductive supporting base 22*a*. The conductive supporting base 22*a* is, for example, an aluminum cylinder having an outer diameter of 30 mm and a thickness of 1 mm.

The charge generation layer 23*a* is formed of, for example, phthalocyanine base pigment having a thickness of 0.2 μm. The charge transport layer 24*a* has, for example, thickness of 20 μm, and is formed of polycarbonate used as binding resin, in which amine compound is mixed as charge transport material. FIG. 2 illustrates just an example of the photosensitive drum 1*a*, and the dimension and material thereof are not limited to those described in this specification.

Figure 3:
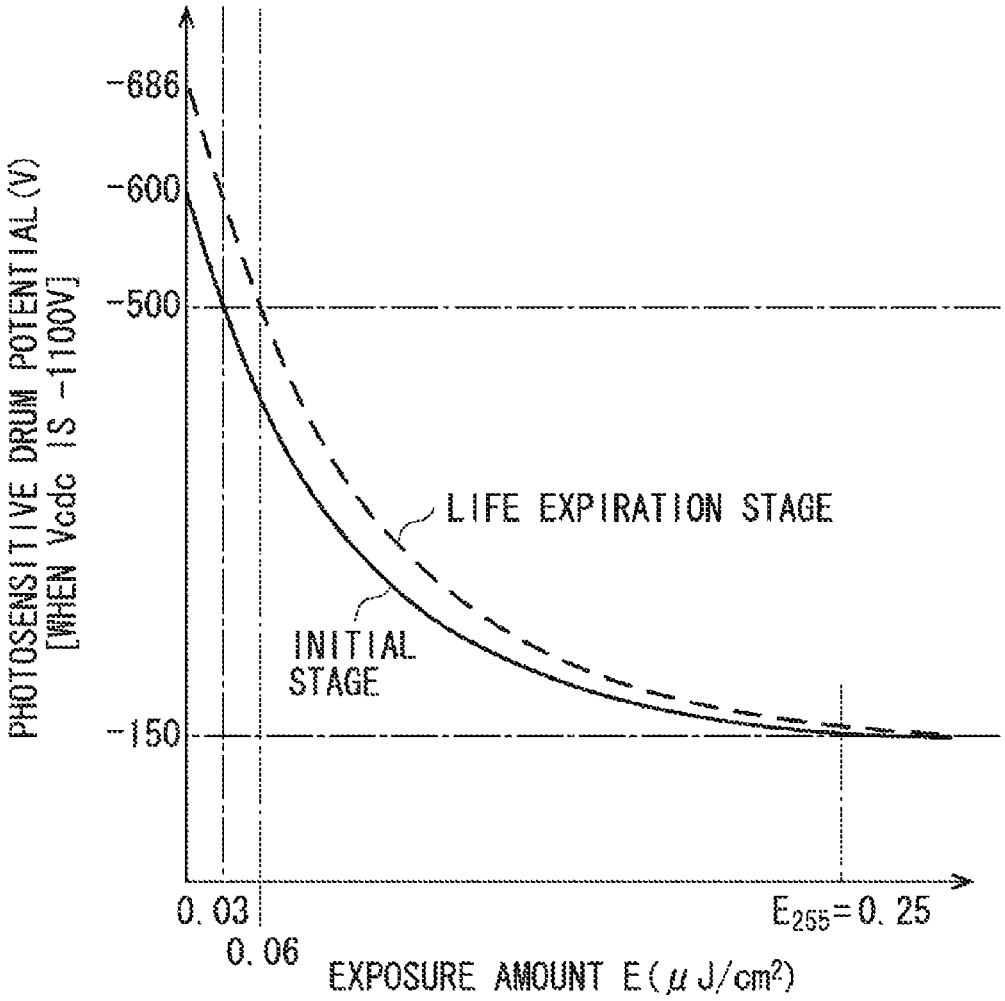
FIG. 3 is a diagram illustrating an example of the sensitivity characteristic (EV curve) of the photosensitive drum.

FIG. 3 illustrates an example of an EV curve indicating the sensitivity characteristic of the photosensitive drum. This diagram indicates an attenuation of potential when a photosensitive drum whose surface is charged to V is exposed to laser beam so that the exposure amount on the surface of the photosensitive drum becomes E ($\mu J/cm^2$).

This EV curve indicates that increasing the exposure amount E causes larger attenuation of potential. A high potential area of this photosensitive drum is in a strong electric field environment, where recombination of charge carriers (pair of an electron and a hole) generated by exposure is unlikely to occur, thereby presenting a high attenuation of potential with a small exposure amount. On the other hand, a low potential area indicates a phenomenon that the attenuation of potential with respect to exposure in a large exposure amount is low because the generated carriers are likely to recombine.

Further, FIG. 3 illustrates an EV curve of an initial stage where the photosensitive drum has begun to be used, and an EV curve when the service life of the photosensitive drum used during a long period is reaching its expiration stage, respectively. A broken-line curve in FIG. 3 indicates the EV curve when the service life of the photosensitive drum is reaching its expiration stage.

The sensitivity characteristic of the photosensitive drum illustrated in FIG. 3 is just an example, and photosensitive drums having various kinds of EV curves can be used in the present exemplary embodiment.

Figure 4:
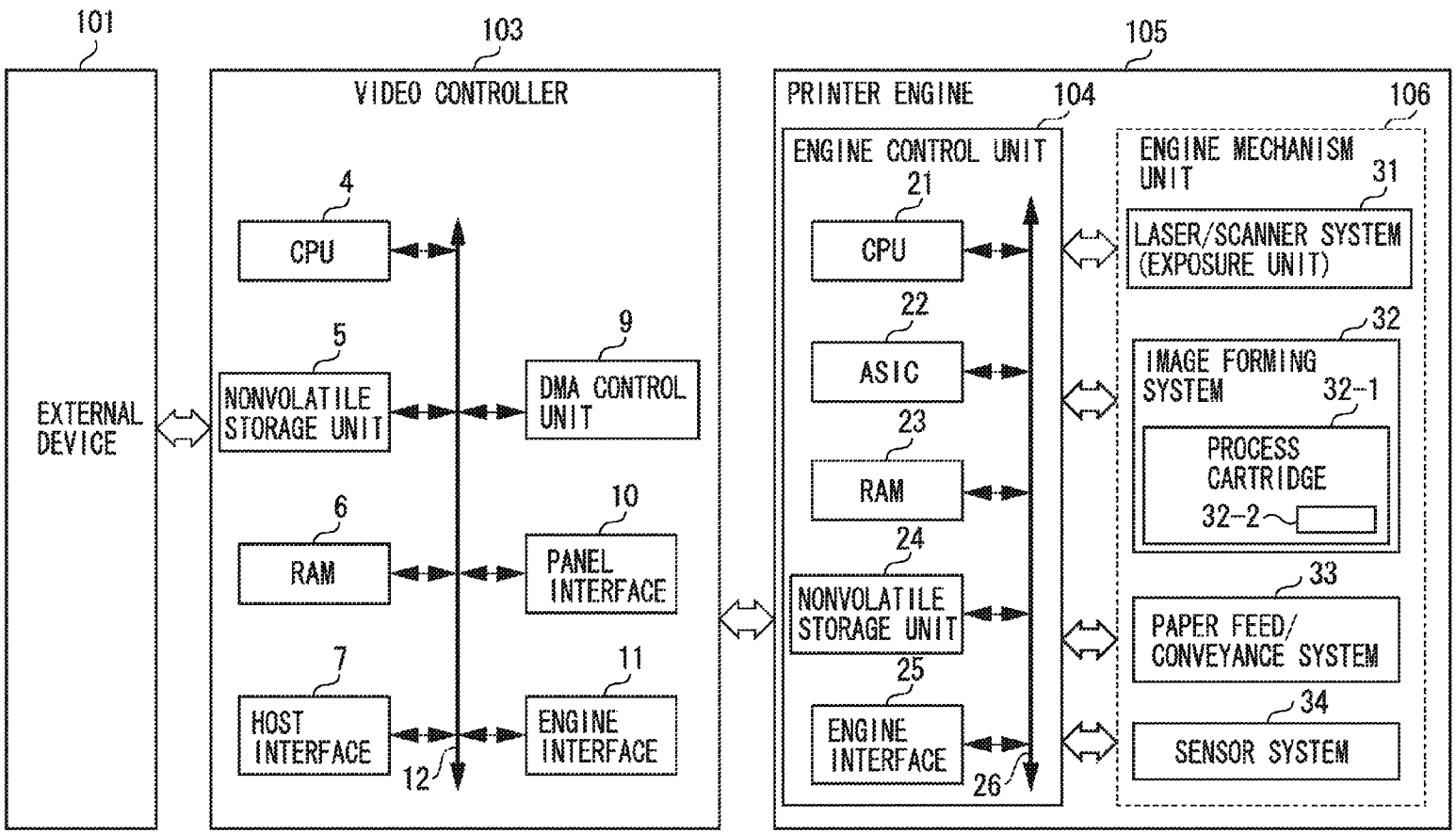
FIG. 4 is a block diagram illustrating an image forming system.

FIG. 4 is a block diagram of an image forming system including an external device 101, a video controller 103, and a printer engine 105. The printer engine 105 includes an engine control unit 104 and an engine mechanism unit 106, which will be described in detail below.

First, the video controller 103 will be described. A CPU 4 controls the entire video controller. A nonvolatile storage unit 5 stores various kinds of control codes to be executed by the CPU 4. The nonvolatile storage unit 5 corresponds to a ROM, an EEPROM, a hard disk and the like. A RAM 6 functions as the main memory and a work area for the CPU 4, functioning as a storage unit for temporary storage.

A host interface unit 7 is an I/O unit for print data and control data, serving as an interface with the external device 101 such as a host computer. Print data received by the host interface unit 7 is stored in the RAM 6.

A DMA control unit 9 transfers image data in the RAM 6 to the engine interface unit 11 according to an instruction from the CPU 4.

A panel interface unit 10 receives various kinds of settings and instructions received from an operator via a panel unit provided on the printer main body. An engine interface unit 11, which serves as an I/O unit for signals with respect to the printer engine 105, transmits a data signal from an output buffer register (not illustrated) and controls communication with the printer engine 105. A system bus 12 contains an address bus and a data bus. The above-mentioned respective components are connected to the system bus 12 to allow access to each other.

Next, the printer engine 105 will be described. The printer engine 105 is divided largely to the engine control unit 104 and the engine mechanism unit 106. The engine mechanism unit 106 is a structure which is operated according to various instructions from the engine control unit 104, and the mechanism relating to formation of images described in FIG. 1 is generally called engine mechanism unit 106.

A laser scanner system 31 functions as an exposure unit and includes a laser light emission device, a laser driver circuit, a scanner motor, a rotating polygon mirror, and a scanner driver. The photosensitive drum is scanned with laser beam based on image data sent from the video controller 103 to form a latent image on the photosensitive drum.

An image forming system 32 serves as a core of this apparatus to form a toner image based on the latent image formed on the photosensitive drum, on a recording medium. The image forming system 32 includes process components including a process cartridge which constructs the image forming station, the intermediate transfer belt and the fixing device. The image forming system 32 further includes a high-voltage power supply circuit configured to generate a variety of biases (high voltages) necessary for formation of images.

A process cartridge 32-1 includes at least a photosensitive drum, and further includes a discharging device, a charging roller, a developing roller and the like in FIG. 4. The process cartridge 32-1 constructs at least a part of the image forming station.

The process cartridge 32-1 has a nonvolatile memory tag 32-2, and a CPU 21 or an ASIC 22 in the engine control unit 104 execute storage (memorization) and reading of various kinds of information into and from the memory tag.

A paper feed/conveyance system controls feeding and conveyance of the recording materials, and is constituted of various kinds of conveyance motors, paper feed/discharge trays, various conveyance rollers and the like.

A sensor system is a group of sensors configured to collect information necessary for the CPU 21 and the ASIC 22, which will be described in detail below, to control the laser scanner system, the image forming system, and the paper feed/conveyance system. This sensor group includes at least publicly known various sensors, for example, a temperature sensor of the fixing device, a residual toner sensor, a density sensor configured to detect the density of images, a paper size sensor, a paper leading edge detection sensor, a paper conveyance detection sensor.

Information detected by these various sensors is acquired by the CPU 21 and reflected on various operations of the image forming system, and print sequence control. Although the sensor system has been separated into the laser scanner system, the image forming system and the paper feed/conveyance system in the above description, the sensor system may be included in any mechanism.

Next, the engine control unit 104 is described. By using the RAM 23 as a main memory and a work area, the CPU 21 controls the aforementioned engine mechanism unit 104 according to various control programs stored in the nonvolatile storage unit 24.

More specifically, the CPU 21 drives the laser scanner system according to print control command and image data input through the engine interface 11 and the engine interface 25 from the video controller 103.

Further, the CPU 21 controls various kinds of print sequences by controlling the image forming system 32 and the paper feed/conveyance system 33. Additionally, the CPU 21 acquires information necessary for controlling the image forming system and the paper feed/conveyance system by driving the sensor system.

On the other hand, the ASIC 22 controls each motor and high-voltage power supply for the developing bias, necessary for executing the aforementioned various print sequences according to instructions from the CPU 21.

In the meantime, part of or all the function of the CPU 21 may be executed by the ASIC 22, or conversely, part of or all of the functions of the ASIC 22 may be executed by the CPU 21 instead. Further, dedicated hardware for part of the functions of the CPU 21 and the ASIS 22 may be provided to execute those functions.

Figure 5A:
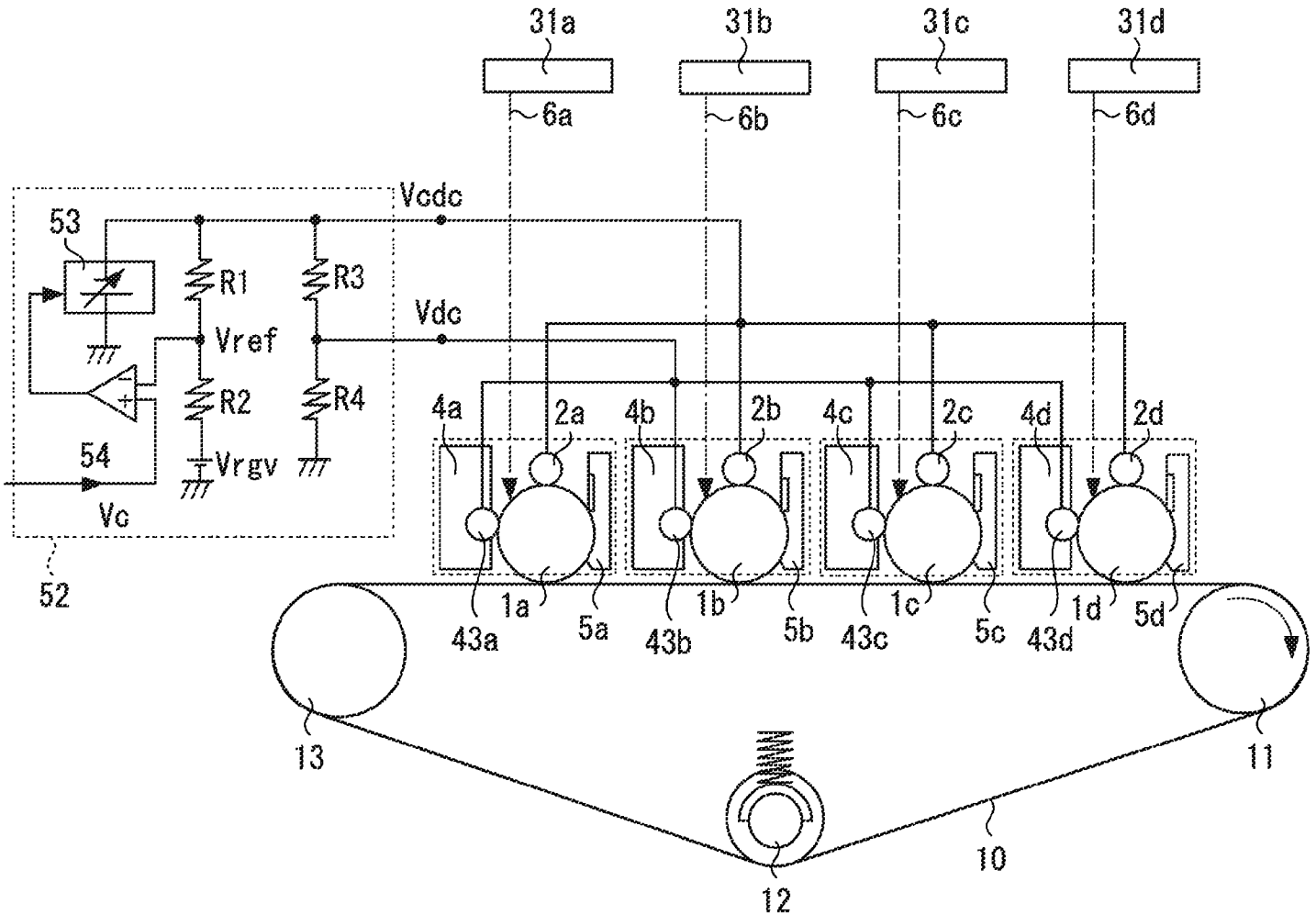
FIGS. 5A, 5B are diagrams illustrating a high-voltage power supply for a charging unit and a developing unit.
Figure 5B:
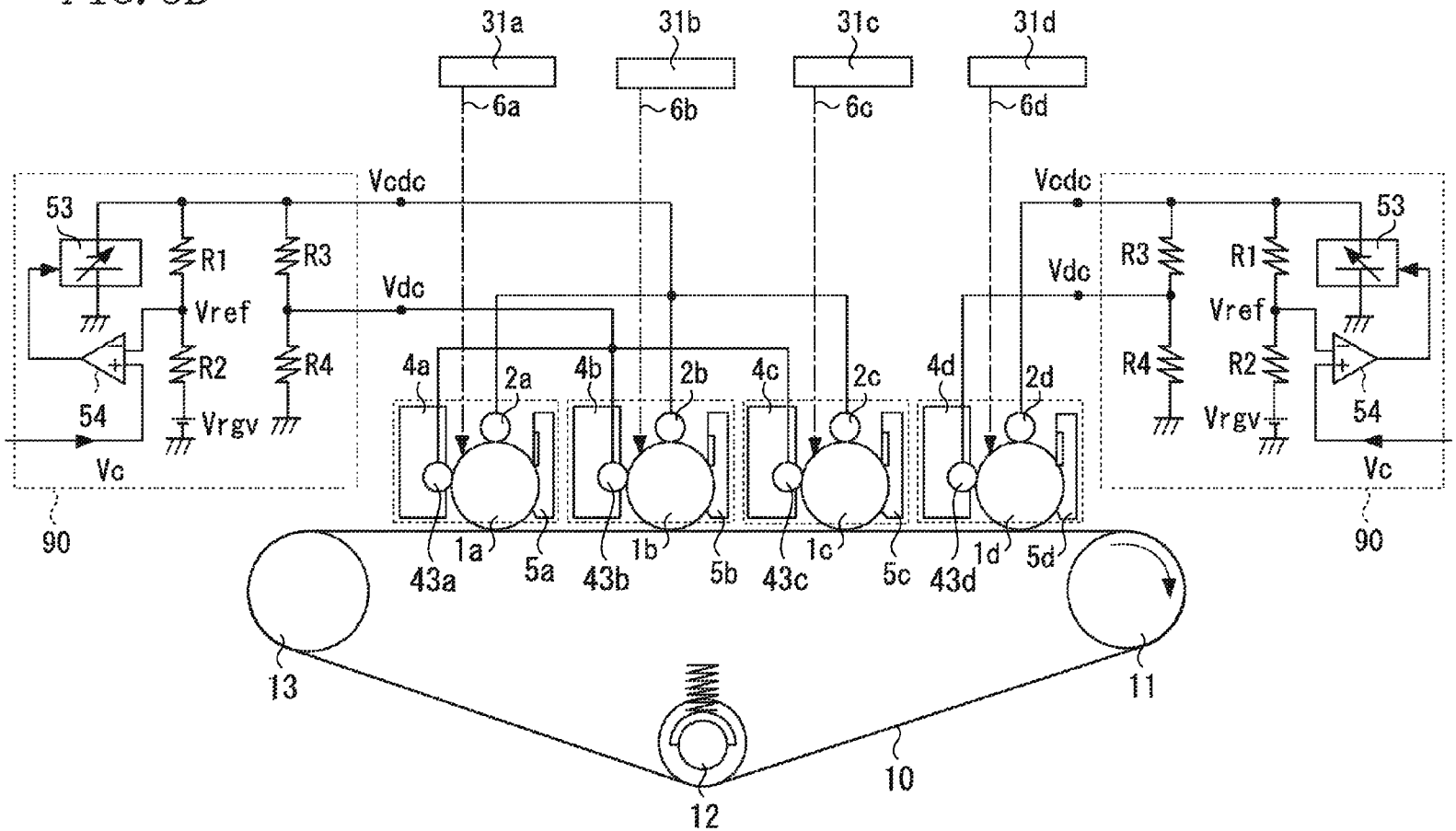

Next, a charging/developing high-voltage power supply 52 will be described with reference to FIGS. 5A and 5B. FIGS. 5A and 5B illustrate examples of the charging/developing high-voltage power supply. In the example of FIG. 5A, the charging rollers 2*a* to 2*d* and the developing rollers 43*a* to 43*d* each corresponding to each of a plurality of colors are connected to the charging/developing high-voltage power supply 52.

The charging/developing high-voltage power supply 52 supplies to the charging rollers 2*a* to 2*d* a charging voltage Vcdc (power supply voltage) output from a transformer 53, and supplies to the developing rollers 43*a* to 43*d* a developing voltage Vdc obtained by dividing the power supply voltage with resistors R3 and R4.

Because in the power supply circuit illustrated in FIGS. 5A and 5B, the power supply system is simplified, voltages to be input (applied) to each roller can be adjusted collectively with a predetermined relationship maintained. However, individual adjustment (individual control) of the voltage cannot be achieved independently of other colors. Similarly, the individual adjustment for the developing rollers cannot be achieved.

The resistors R3 and R4 may be implemented of a fixed resistor, a semi-fixed resistor or a variable resistor.

Referring to FIGS. 5A and 5B, a power supply voltage from the transformer 53 is input directly into the charging rollers 2*a* to 2*d*, and the voltage obtained by dividing the voltage output from the transformer 53 with the fixed resistors is input directly into the developing rollers 43*a* to 43*d*. However, this is just an example, and it is not limited to this voltage input style. Various voltage input styles to the individual rollers (charging units and developing units) can be considered.

For example, instead of the output from the transformer 53, it is possible to input a converted voltage obtained by DC-DC conversion by a converter or a voltage obtained by dividing or dropping the power supply voltage by using an electronic device having a fixed voltage drop characteristic into the charging rollers 2*a* to 2*d*.

Further, the conversion voltage obtained by DC-DC converting the output from the transformer 53 with the converter or the voltage obtained by dividing or dropping the power supply voltage by using an electronic device having the voltage drop characteristic may be input into the developing rollers 43*a* to 43*d*.

As the electronic device having the fixed voltage drop characteristic, for example, the resistor, a Zener diode can be used. The converter includes a variable regulator. Dividing or dropping the voltage with an electronic device includes, for example, further dropping a voltage obtained by dividing a voltage or increasing a voltage obtained by dividing a voltage.

On the other hand, to control the charging voltage Vcdc to be substantially constant, the charging voltage Vcdc is dropped with a R2/(R1+R2) to produce a negative voltage and this negative voltage is offset to positive-pole voltage by a reference voltage Vrgv to produce a monitor voltage Vref. Then, feedback control is executed to maintain the monitor voltage Vref to be a constant value.

More specifically, a control voltage Vc set preliminarily by the engine control unit 104 (CPU 21) is input to a positive terminal of an operational amplifier 54 while the monitor voltage Vref is input to a negative terminal. The engine control unit 104 changes the control voltage Vc appropriately depending on the conditions. An output of the operational amplifier 54 feed-back controls the control/drive system of the transformer 53 so that the monitor voltage Vref becomes equal to the control voltage Vc.

Consequently, the charging voltage Vcdc output from the transformer 53 is controlled to be a target value.

For the output control of the transformer 53, an output of the operational amplifier 54 may be input to the CPU so that a calculation result of the CPU is reflected on the control/drive system of the transformer 53. According to the present exemplary embodiment, the charging voltage Vcdc is controlled to be −1100 V and the developing voltage Vdc is controlled to be −350 V. Under such a control, the charging rollers 2*a* to 2*d* charge the surfaces of the photosensitive drums 1*a* to 1*d* with the charging potential Vd.

FIG. 5B illustrates another example charging/developing high-voltage power supply. The same reference numerals are attached to the same components as those in FIG. 5A, and description thereof is omitted.

In FIG. 5B, the power supply is divided to at least two different units, i.e., a charging/developing high-voltage power supply 90 for the image forming stations for yellow, magenta, and cyan, and a charging/developing high-voltage power supply 91 for the image forming station for black. When forming an image at full color mode, the charging/developing high-voltage power supplies 90 and 91 are turned on.

On the other hand, when forming an image at mono-color mode, the charging/developing high-voltage power supply 90 for the image forming stations for yellow, magenta, and cyan is kept off, while the charging/developing high-voltage power supply 91 for the image forming station for black is turned on. In FIG. 5B, the same control as that illustrated in FIG. 5A is performed on the charging/developing high-voltage power supply 90 for the image forming stations for yellow, magenta and cyan.

In the charging/developing high-voltage power supplies illustrated in FIGS. 5A, 5B, the high-voltage power supplies are used in common respectively for their charging rollers and developing rollers, thereby achieving a smaller size of the apparatus.

In addition, with this configuration, cost can be reduced compared to a case where transformers that can change the output voltage for each color are provided to control the input voltage individually for each developing unit.

In addition, with this configuration, cost can be reduced compared to a case where the DC-DC converter (variable regulator) is provided for each charging unit and each developing unit to control the output of a transformer individually for each charging unit and the developing unit.

The configuration of the image forming apparatus has been described above. Hereinbelow, a procedure for causing each exposure unit (beam irradiation unit) to perform weak exposure on an area where a toner image is not to be visualized will be described with reference to FIG. 6 to FIGS. 9A, 9B, based on the configuration illustrated in FIG. 1 to FIGS. 5A, 5B.

Further, a method for causing each exposure unit to perform the normal emission, in which an amount of light determined based on image data for image forming is added to an amount of light of the weak emission, for an area where a toner image is to be visualized.

Hereinafter, the configuration and operation of the exposure unit 3*a* in the first image forming station a will be described as a representative below. However, the same configuration and operation are achieved in the exposure units 3*b* to 3*d* in the second to fourth image forming stations.

Figure 6:
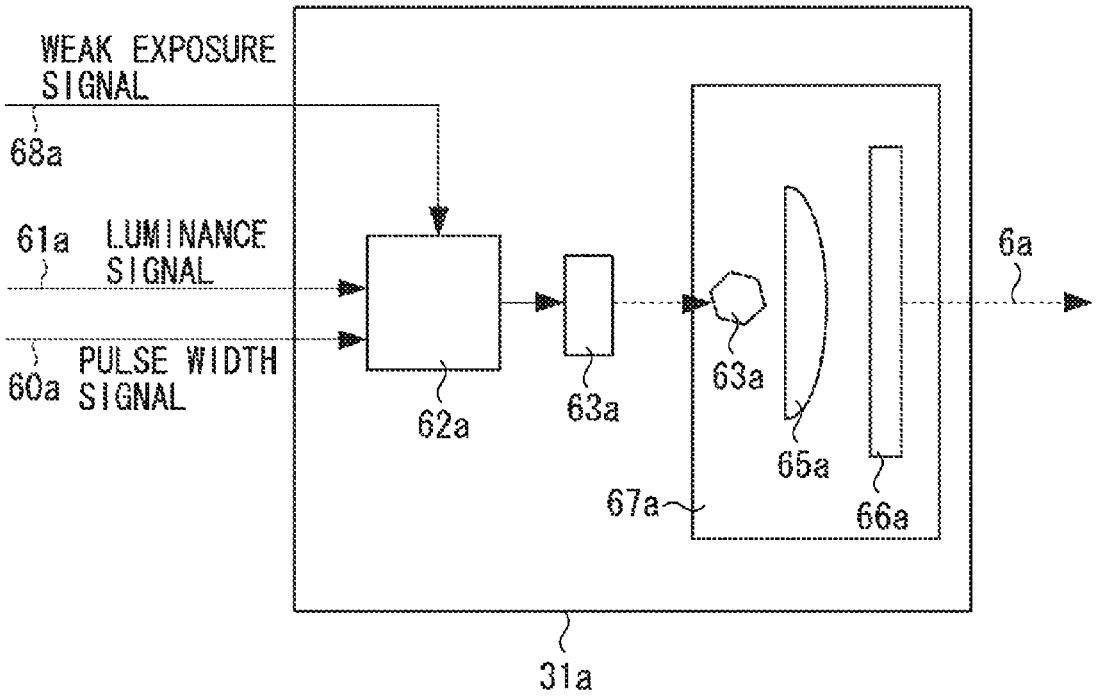
FIG. 6 is a diagram illustrating an exposure unit having weak exposure function.

The weak exposure control of the laser beam 6*a* by the exposure unit 3*a* in an area where the toner image on the photosensitive drum 1*a* is not to be visualized will be described with reference to FIG. 6. In the meantime, the same configuration as that illustrated in FIG. 6 is provided for the weak exposure control on the photosensitive drums 1*b* to 1*d*, and a detailed description thereof is omitted.

First, an operation of the engine control unit 104 will be described. In an exposure for forming an electrostatic latent image on the photosensitive drum, the engine control unit 104 controls an exposure amount $E_0$ of the weak exposure to expose the background area where the toner image is not to be visualized with a weak exposure signal 68*a*.

The engine control unit 104 controls an exposure amount $E_x$ for the normal exposure for use in exposure of the area where the toner image is to be visualized according to a pulse width signal 60*a*. More specifically, the control based on the weak exposure signal 68*a* and the pulse width signal 60*a* is light-emitting time control.

A laser driver 62*a* includes an OR circuit, which performs OR operation on a pulse signal of the weak exposure signal 68*a* and a pulse signal of the pulse width signal 60*a*. The laser driver 62*a* drives the laser diode 63*a* to emit light according to the pulse signal generated through the OR processing. Further, the engine control unit 104 controls the light-emission intensity of the laser driver 62*a* according to the luminance signal 61*a*.

The exposure amount described above is expressed in a unit of $\mu J/cm^2$. That is, the exposure amount means light energy converted into per unit area when the laser diode 63*a* emits light beam over a certain area in a certain time at a certain light-emission intensity.

However, in exposure of the background area (non image forming area) to which no toner is applied, the entire area is actually irradiated with light not evenly but intermittently by the laser diode 63*a*. In this case, the exposure amount may be regarded as substantially average light energy (μJ) per unit area.

Depending on the response characteristic of the laser diode 63*a*, when the pulse drive time is short, the peak value of the light beam pulse drops. Consequently, substantially the light-emission intensity is controlled, which affects the aforementioned average light beam energy (μJ). Then, by changing a pulse width $PW_{MIN}$ in the background exposure (weak exposure) or changing the laser light-emission intensity of the laser diode 63*a*, a substantial exposure amount ($\mu J/cm^2$) can be adjusted and controlled.

The actual exposure amount is affected by the characteristic of a correction optical system 67*a* in a direction of reducing the exposure amount E. In the present exemplary embodiment, a light emission condition of the laser diode 63*a* about the exposure amount is set taking this phenomenon into account. However, irrespective of the degree of an influence of the characteristic of the correction optical system 67*a*, it is apparent that the exposure amount E can be changed by the light-emitting time or light beam intensity of the laser diode 63*a*.

The pulse width signal 60*a* will be described in detail. This pulse width signal 60*a* is a signal expressed with image data of, for example, 8-bit (256 gradations) multi-value signals (0 to 255) to determine the laser beam emission time. When the image data is 0 (background area), the pulse width is $PW_{MIN}$ (e.g., 12.0% of a single pixel), and when the image data is 255, the pulse width is equivalent to a single pixel ($PW_{255}$) under a full exposure.

For image data of 1 to 254, for example, a pulse width ($PW_x$) proportional to the gradation value is generated between $PW_{MIN}$ and $PW_{255}$. This will be described in detail according to an equation (1) described below.

The case where the image data for controlling the laser diode 63*a* is of 8 bits (256 gradations) is just an example, and the image data may be, for example, a 4-bit (16 gradations) or 2-bit (4 gradations) multi-value signal after undergoing halftone processing. Further, the image data after undergoing the halftone processing may be a binarized value.

On the other hand, the engine control unit 104 changes the weak exposure signal 68*a* and the luminance signal 61*a* in conjunction with a remaining service life of the photosensitive drum to control the weak exposure amount $E_0$ of the background area to an appropriate value. The width of a pulse signal output in response to an instruction of the weak exposure signal 68*a* from the engine control unit 104 basically coincides with the pulse width $PW_{MIN}$ (e.g., 12.0% of a single pixel) when the image data is 0 (background area).

However, a calculated-back exposure amount $E_0$ (pulse width), which is calculated back from the exposure amount (pulse width) when the image data (density) is not 0, may not necessarily coincide with the weak exposure amount (pulse width $PW_{MIN}$) when the image data is 0.

If the average surface potential per a pixel is not lower than the developing potential and evenness of charge is achieved, when the weak exposure is executed, it is apparent that a specific effect can be obtained even if approximate values to each other are set for the calculated-back exposure amount $E_0$ and the weak exposure amount.

As described above, the weak exposure amount $E_0$ is set based on the characteristic of the photosensitive drum so that the average surface potential per an image obtained in exposure is not lower than the developing potential (e.g., approximately −400 V) and additionally, the potential is attenuated to attain the evenness of charge.

According to the EV curve illustrated in FIG. 3, light beam is output in response to an instruction from the engine control unit 104 with the $PM_{MIN}$ being 12.0% of the $PW_{255}$ required for a single pixel, and consequently, the weak exposure amount $E_0$ at the initial period is set to 0.03 $\mu J/cm^2$, thereby achieving a potential attenuation of 100 V in the background area. Further, a maximum exposure amount $E_{255}$ when executing full-exposure with $PW_{255}$ is set to be 0.25 $\mu J/cm^2$, which is an exposure amount in an area where the EV curve in FIG. 3 is nearly a horizontal state, in order to prevent the surface potential by the exposure from being deflected.

Then, the laser driver 62*a* controls the laser luminance (laser light-emission intensity) and the light-emitting time of the laser diode 63*a* according to the luminance signal 61*a* issued from the engine control unit 104, the pulse width signal 60*a* based on the image data, and the weak exposure signal 68*a*.

The laser driver 62*a* executes automatic light amount control to control the amount of current supplied to the laser diode 63*a* to be a target luminance (mW). The luminance can be controlled by adjusting current supplied by the laser driver 62*a* to the laser diode 63*a*.

The laser beam 6*a* emitted from the laser diode 63*a* is used for optical scanning and irradiated over the photosensitive drum 1*a* through a correction optical system 67*a* including a polygon mirror 64*a*, a lens 65*a*, and a folding mirror 66*a*.

When the above-described weak light beam emission is executed, a after-correction charging potential Vd_bg of the non-image forming area drops from a before-correction charging potential Vd of −600 V to −500 V. On the other hand, the exposure potential V1 of the image forming area is changed from the charging potential Vd of −600 V to V1 of −150 V due to full light emission of the laser diode 63*a*. The similar operation is executed by each laser diode 63.

Although an example in which the exposure is executed with the laser diode 63 has been described with reference to FIG. 6, it is not limited thereto. For example, this exemplary embodiment may be realized with a system containing an LED array as the exposure unit.

More specifically, the signal described referring to FIG. 6 may be input to a driver configured to drive each light emission diode (LED), and the processing in the flowchart in FIG. 7 described below may be performed. The exposure system with the laser diode 63*a* will be described below.

A problem concerning a difference in drum film thickness will be described with reference to FIG. 8A. As utilization of the photosensitive drum is progressed, the surface of the photosensitive drum is deteriorated due to discharging of the charging unit and the surface of the photosensitive drum is scraped due to friction with a cleaning unit, so that the film thickness on the photosensitive drum is reduced. If any photosensitive drum having a different usage condition (e.g., the integrated number of rotations) exists, the film thicknesses of the photosensitive drums are varied.

If in this state, a predetermined charging voltage Vcdc is applied to a plurality of photosensitive drums from the commonly used high-voltage power supply illustrated in FIGS. 5A and 5B, a difference in potential generated in air gap between the charging unit and the photosensitive drum differs. As a result, the charging potential Vd is varied.

More specifically, because the film thickness of a photosensitive drum used not so frequently for forming images is large, and the difference in potential generated in the air gap between the charging unit and the photosensitive drum is small, the absolute value of the charging potential Vd is reduced.

On the other hand, because a photosensitive drum having a large integrated number of rotations has a small film thickness, and the difference in potential generated in the air gap between the charging unit and the photosensitive drum is large, the absolute value of the charging potential Vd is increased.

Figure 8A:
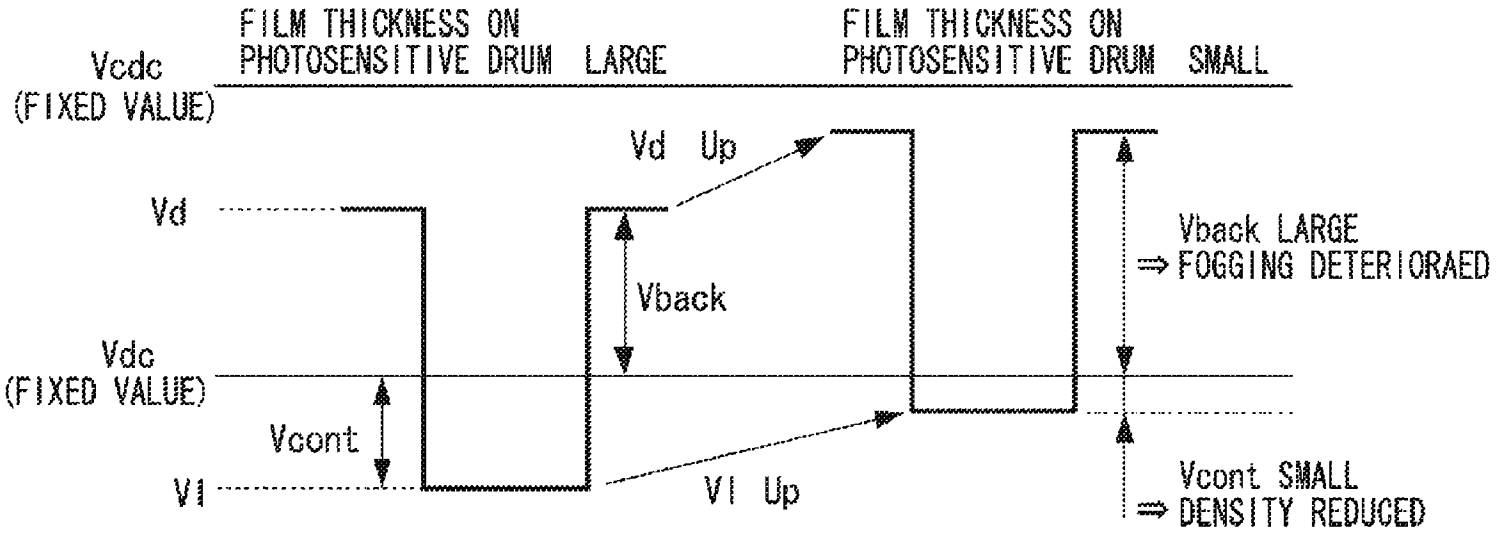
FIGS. 8A, 8B, and 8C are diagrams illustrating relationships between the film thickness of the photosensitive drum, charging potential, development potential, and exposure potential.

When, for example, in a photosensitive drum having a large film thickness, the developing potential Vdc and the charging potential Vd are set so that a back-contrast Vback (=Vd–Vdc), which is a contrast between the developing potential Vdc and the charging potential Vd, becomes a desired state, following problems occur as illustrated in FIG. 8A.

That is, in an image forming station containing a photosensitive drum having a small film thickness, the absolute value of the charging potential Vd is increased, so that the back-contrast Vback is increased. When the back-contrast Vback is increased, toner not charged with a normal polarity (in a case of reversal development like in the present exemplary embodiment, the toner charged with 0 to positive polarity without being charged with a negative polarity) is transferred from the developing unit to the non-image forming area, fogging is generated.

Further, because, in an image forming station containing a photosensitive drum having a small film thickness, the charging potential Vd is increased, an exposure potential V1 is also increased in a configuration having a constant exposure intensity. Consequently, a development contrast Vcont (=Vdc–V1), which is a difference value between the developing potential Vdc and the exposure potential V1, is decreased, so that toner cannot be transferred electrostatically to a sufficient extent from the developing unit to the photosensitive drum, thereby a low density being likely to be generated in a solid black image.

Figure 8B:
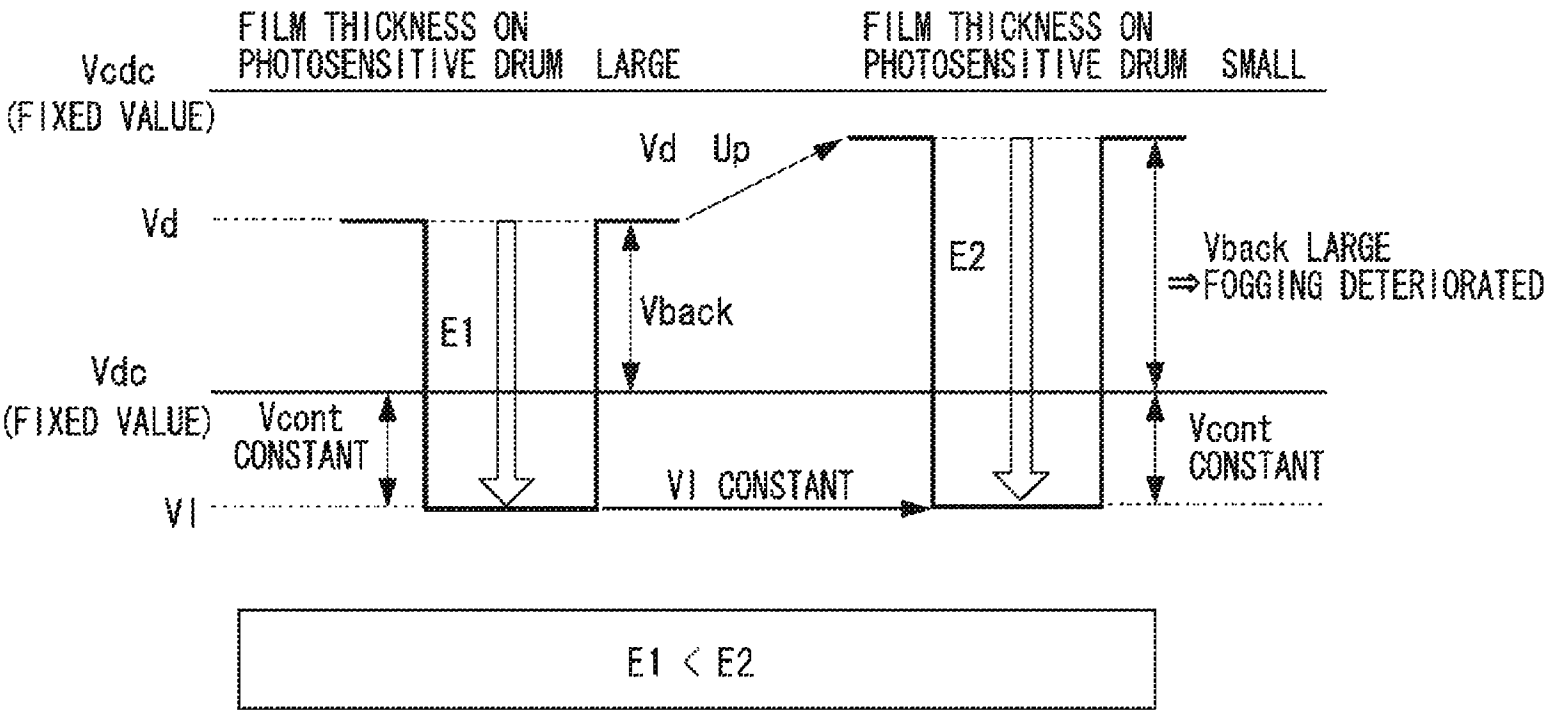

On the other hand, by changing the exposure intensity from E1 to E2 with a developing voltage and a charging voltage fixed as illustrated in FIG. 8B, the development contrast Vcont, which is the difference value between the developing potential Vdc and the exposure potential V1, can be controlled to be substantially constant by individual control of each exposure intensity.

As a consequence, the density can be kept constant. However, the back-contrast Vback, which is a contrast between the developing potential Vdc and the charging potential Vd, is expanded, thereby leaving the above-described problem about occurrence of fogging.

As regards the above-mentioned fault, even if the high-voltage power supply is not used in common as described above, when the control capacity (voltage conversion capacity) of each high-voltage power supply is insufficient or no independent power supply control is executed, the same problem may occur.

On the other hand, according to the present exemplary embodiment, even the configuration of the power supply as illustrated in FIGS. 5A and 5B can prevent generation of the fogging and the low density with the simple structure.

The processing for correcting each weak exposure amount $E_0$ of the laser diodes 62*a* to 62*d* on a background area (non-image forming area) having no adhering toner in conjunction with a remaining service life of the photosensitive drums 1*a* to 1*d* will be described with reference to the flowchart illustrated in FIG. 7.

In step S101, the engine control unit 104 reads an integrated number of rotations of a photosensitive drum as information concerning the remaining service life of the photosensitive member from the storage member of each station. The storage unit for storing information concerning the remaining service life of each photosensitive drum is not limited to the storage member of each station.

For example, it is useful to store information read from the storage member of each station into another storage unit temporarily, and then read and update the information stored therein for subsequent use. In this case, the information contained in another storage unit is reflected to the storage unit of each station when the power supply of this apparatus is turned off or a print job is ended.

The information concerning the remaining service life of the photosensitive member can be reworded as information concerning usage condition, i.e., how many times the photosensitive member has been rotated or how long the photosensitive member has been used. As described referring to FIG. 3, this can be reworded as information concerning the photosensitive characteristic (EV curve characteristic) of the photosensitive drum. All of them mean the same.

As a modification of the information concerning the remaining service life of the photosensitive member, other information related to the film thickness of the charge transport layer 24*a* can be exemplified. For example, the information about the number of rotations of the intermediate transfer belt, the number of rotations of the charging roller, and the number of prints including the paper size can be exemplified.

It is useful to provide a unit configured to detect the film thickness of the photosensitive drum directly, corresponding to each photosensitive drum, and use its detection result as information concerning the remaining service life of the photosensitive drum. Further, the value of a charging current flowing through the charging roller, a drive time of the motor configured to drive the photosensitive member, and a drive time of the motor configured to drive the charging roller may be adopted as the information concerning the remaining service life of the photosensitive member.

In step S102, the engine control unit 104 refers to a table illustrated in FIG. 9A or 9B which specifies a correspondence relationship between the integrated number of rotations of the photosensitive drum (usage status of the photosensitive drum) and a parameter concerning the normal exposure The information acquired in step S101 for each photosensitive drum differs with each other. Therefore, the engine control unit 104 refers to the table in FIG. 9A or FIG. 9B for each photosensitive drum. The engine control unit 104 sets an exposure parameter for the normal exposure amount of the laser diodes 62*a* to 62*d*, based on the information about the integrated number of rotations acquired in step S101.

It is assumed that the tables illustrated in FIGS. 9A and 9B are stored in the storage unit which the engine control unit 104 can refer to.

Through processing of step S102, the engine control unit 104 acquires a laser light emission setting for changing the exposure potential V1 of each photosensitive drum to a target potential or a tolerable potential, regardless of the sensitivity characteristic (EV curve characteristic) of each photosensitive drum. This acquired setting can reduce variability of the after-exposure potential V1 after the normal exposure in each of the plurality of photosensitive members by causing the normal light beam emission of the laser diodes 62*a* to 62*d*.

Although, basically, the target exposure potential of each photosensitive drum is equivalent or substantially equivalent to each other, the target exposure potential may be set independently according to the characteristic of each photosensitive drum.

An operation of the engine control unit 104 in step S102 will be described further in detail. First, the engine control unit 104 sets a luminance (mW) corresponding to acquired integrated information of each photosensitive drum as luminance signals 61*a* to 61*d*.

Although FIGS. 9A and 9B illustrate the luminance (mW) for the purpose of description thereof, actually, the engine control unit 104 sets a voltage value/signal corresponding to this luminance as luminance signals 61*a* to 61*d*. The engine control unit 104 sets a % pulse width modulation (PWM) value of the normal exposure (density 0%) in FIGS. 9A and 9B at $PW_{MIN}$, and the PWM value of the normal exposure at $PW_{255}$.

The engine control unit 104 sets a pulse width for image data of an arbitrary gradation value n (=0 to 255) according to a following equation (1).

$$PW_n = n \times (PW_{255} - PW_{MIN})/255 + PW_{MIN} \quad \text{equation (1)}$$

According to the equation (1), $PW_0$ equals to $PW_{MIN}$ ($PW_0 = PW_{MIN}$) when equals to 0 (n=0), and equals to $PW_{255}$ ($PW_0 = PW_{255}$) when n equals to 255 (n=255). When light emission based on image data of an arbitrary gradation value n is instructed from outside, the engine control unit 104 instructs a voltage value/signal corresponding to the pulse width ($PW_n$) set here as the pulse width signal 60*a*. The same procedure is executed for the pulse width signals 60*b* to 60*d*.

As for the equation (1), a 8-bit multi-value signal is assumed. A following procedure is applied for an arbitrary m-bit signal such as 4-bit signal, 2-bit signal, or 1-bit (binary) signal as described referring to FIG. 6. That is, a pulse width at the time of $PW_{MIN}$ may be allocated to image data 0, and a pulse width at the time of $PW_{255}$ may be allocated to a gradation value ($2^m - 1$).

Description of following steps is continued. In step S103, the engine control unit 104 sets a parameter concerning a laser beam emission amount $E_0$ for the weak exposure (% PWM value for the weak exposure in FIGS. 9A and 9B) based on the integrated number of rotations. In step S103, the engine control unit 104 refers to the tables of FIGS. 9A and 9B for each photosensitive drum.

More specifically, the engine control unit 104 sets a % PWM value for the weak exposure corresponding to the integrated information acquired in step S101 for each photosensitive drum, and then sets respective voltage value/signal as the weak exposure signals 68*a* to 68*d*. Through the processing of this step S103, the engine control unit 104 can acquire a setting for changing the charging potential Vd of each photosensitive drum to a target potential (after-correction charging potential Vd_bg) or a tolerable potential, irrespective of the sensitivity characteristic (EV curve characteristic) of the photosensitive drum.

The acquired setting can reduce variability of the after-correction charging potential on the background area (non-image forming area) of each of the plurality of photosensitive members by the weak light beam emission of the laser diodes 62*a* to 62*d*. Although, basically, the target exposure potential of each photosensitive drum is equivalent or substantially equivalent to each other, it may be set individually according to the characteristic of each photosensitive drum depending on a case.

Through the processing in step S102 and step S103, the exposure amounts for the weak exposure and the normal exposure can be appropriately set in conjunction with the remaining service life of the photosensitive drum.

Although it has been described that the engine control unit 104 refers to the tables in FIGS. 9A and 9B, in steps S102 and S103, the present exemplary embodiment is not limited thereto. For example, it is possible to obtain a desired setting value (normal/weak exposure parameters) from a parameter concerning the remaining service life of the photosensitive drum by calculation based on an equation contained in the CPU 21.

Further, it is also possible to store all values calculated according to the equation (1) preliminarily on the table, which the engine control unit 104 refers to each time.

Alternatively, the nonvolatile storage unit 24 may store a plurality of EV curves as illustrated in FIG. 3 corresponding to a usage status of the photosensitive drum, and the engine control unit 104 may select an EV curve according to information concerning the usage status of the photosensitive drum to calculate a necessary exposure amount ($\mu J/cm^2$) from the specified EV curve and a desired photosensitive drum potential.

In this case, the engine control unit 104 further calculates a laser luminance, a pulse width at the time of the weak exposure, or a pulse width at the time of the normal exposure from an exposure amount ($\mu J/cm^2$) obtained each time, and sets its result as a parameter corresponding to steps S102 and S103.

Figure 7:
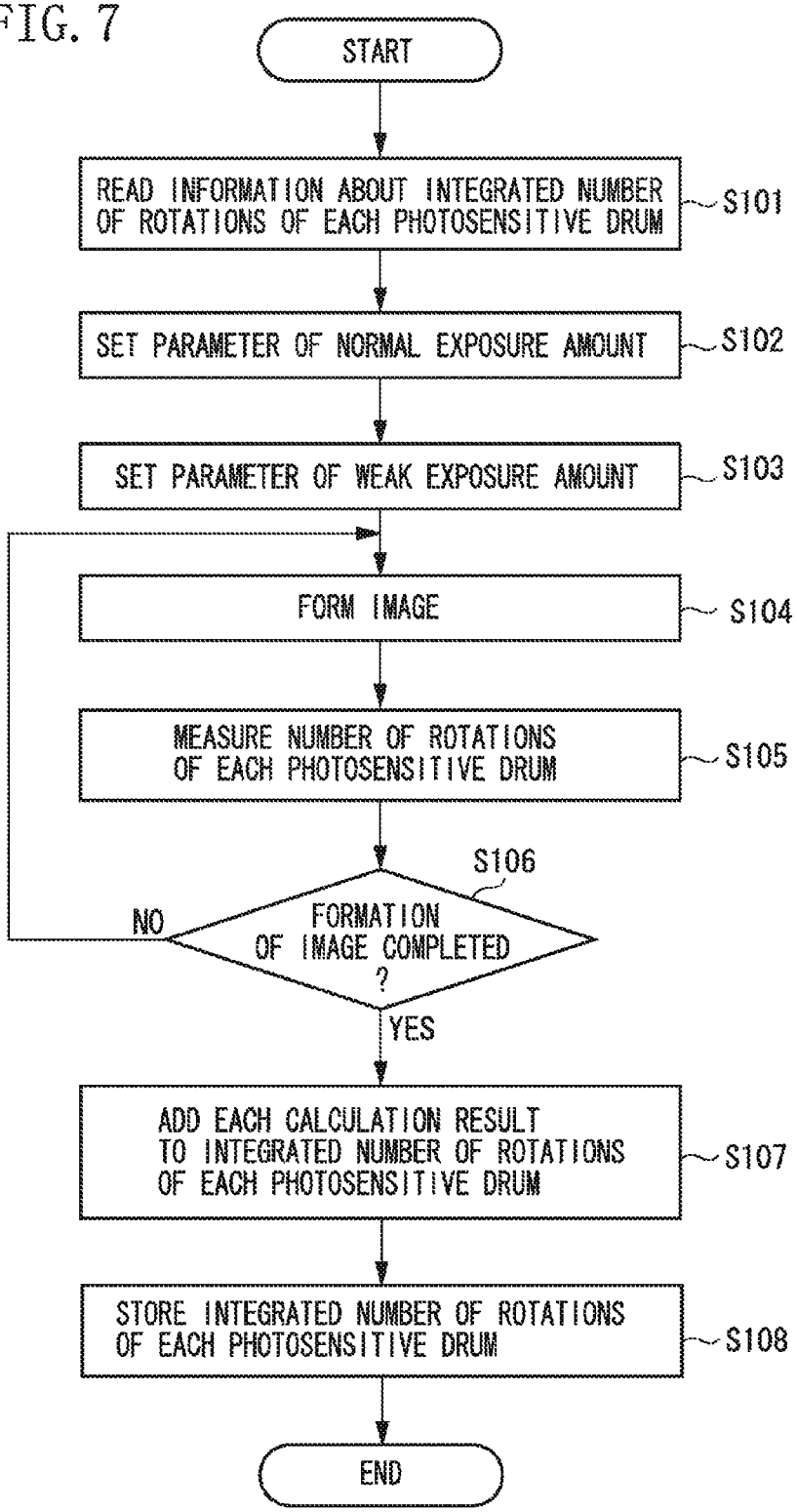
FIG. 7 is a flow chart illustrating a setting processing for weak exposure parameters and normal exposure parameters, an image forming processing and a photosensitive drum usage condition update processing.

Returning to the description in FIG. 7, in step S104, under the control instructions of the engine control unit 104, each unit executes a series of the image forming operations and controls described referring to FIG. 1.

In step S105, the engine control unit 104 measures a number of rotations of each of the photosensitive drums a to d which are rotated for a series of the image forming steps. This measurement processing is used to update the usage status of the photosensitive drums. Further, this processing in step S105 is executed in parallel to the processing in step S104.

In step S106, the engine control unit 104 determines whether the image formation is completed, and if it is determined that the image formation is completed (YES in step S106), the processing proceeds to step S107.

In step S107, the engine control unit 104 adds a result of each photosensitive drum measured in step S105 to a corresponding integrated number of rotations. In step S108, the engine control unit 104 stores the updated integrated number of rotations into the nonvolatile memory tag 32-2 of each station.

As a result of the processing of this step S106, the information about the remaining service life of the photosensitive drum is updated. The storage destination may be a different storage unit from the memory tag 32-2 as described in step S101.

FIGS. 9A and 9B are tables illustrating the information concerning the remaining service life of a photosensitive drum referred to in step S102 and step S103 in FIG. 7 related to the light emission control setting for the weak exposure and the normal exposure in detail.

For example, the table is stored in the nonvolatile storage unit 24 illustrated in FIG. 4. In both FIGS. 9A and 9B, it is assumed that the exposure amount ($\mu J/cm^2$) for the weak exposure and the exposure amount ($\mu J/cm^2$) for the normal exposure are set preliminarily based on the sensitivity characteristic (EV curve) of a target photosensitive member, as illustrated in FIG. 3.

By referring to the tables illustrated in FIGS. 9A and 9B, the engine control unit 104 can keep variability of the surface potential of the background area after charging on the same level, or at least reduce it. Further, the engine control unit 104 can keep variability of the after-exposure potential V1 of each of the plurality of photosensitive members after the normal exposure on the same level, or at least reduce it.

First, FIG. 9A is described by referring to the EV curve illustrated in FIG. 3. When the film thickness of the charge transport layer 24*a* of the photosensitive drum 11*a* on the initial condition is 20 μm, it is necessary to set the exposure amount for the exposure of the background area to 0.03 $\mu J/cm^2$.

On the other hand, the dotted curve in FIG. 3 is an EV curve of the photosensitive drum 11*a* at life expiration stage, where the charging potential Vd rises because the film thickness of the charge transport layer 24*a* is reduced to 10 μm. To keep the potential of the background area in the photosensitive drum 11*a* at −500 V with respect to this charging potential Vd like on the initial stage, the exposure amount needs to be set to 0.06 $\mu J/cm^2$.

Because the abrasion of the charge transport layer 24*a* of the photosensitive drum 11*a* is accelerated due to charging corrosion at a drum cleaner 17*a* in contact therewith and a charging unit, the abrasion amount of the photosensitive drum 11*a* is substantially proportional to the integrated number of rotations of the photosensitive drum.

Based on a result of a preliminary experiment indicating that the charge transport layer 24*a* is worn by 1 μm by 15,000 rotations (corresponding to printing 500 pages), the integrated number of rotations is related to the film thickness of the charge transport layer 24*a*. That is, according to FIG. 9A, by increasing the $PW_{MIN}$ every 15,000 rotations in integrated number of rotations, the exposure amount $E_0$ of the weak exposure is increased by 0.003 $\mu J/cm^2$ only.

Then, the exposure amount $E_0$ of the weak exposure is set so that the exposure amount $E_0$ is changed linearly from 0.03 $\mu J/cm^2$ to 0.06 $\mu J/cm^2$ from the initial stage to the end stage of the usage status of the photosensitive drum. By this control, the engine control unit 104 holds the background area potential at a substantially constant value of −500 V, regardless of the film thickness of the charge transport layer 24*a* of the photosensitive drum 11*a*.

In FIG. 9A, the relationship between the luminance for the normal exposure for the area where the toner image is to be visualized and the integrated number of rotations of the photosensitive drum is set. In FIG. 9A, a constant luminance (mW) is set regardless of an operating status (integrated number of rotations) of the photosensitive drum. This means that the characteristic of the photosensitive drum assumed in FIG. 9A corresponds to a case where that setting has substantially no problem.

On the other hand, in the table illustrated in FIG. 9B, both the pulse width $PW_{MIN}$ (light-emitting time) of the weak exposure and the luminance (mW) at the time of the normal exposure change.

By referring to the table in FIG. 9B, the engine control unit 104 can set not only the weak exposure but also the normal exposure in conjunction with the integrated number of rotations of the photosensitive drum. The table in FIG. 9B is very effective for a photosensitive drum having such a characteristic that even the luminance for the normal exposure needs to be changed.

Although FIGS. 9A and 9B illustrate the light emission control setting for the weak exposure and the normal exposure to a certain range of the integrated number of rotations of the photosensitive drum, the light emission control may be set further in detail. For example, the CPU 21 of the engine control unit 104 may perform an estimated calculation to obtain an appropriate light emission control setting value with respect to an arbitrary number of rotations of the drum according to the relation between the number of rotations of the drum and the light emission control setting value in the table.

The same procedure may be performed for the normal exposure also. As a result, precision in the exposure amount of the laser diode 63*a* for the weak exposure and the normal exposure can be improved.

A case of increasing both the weak exposure amount and the normal exposure amount linearly according to the integrated number of rotations of the photosensitive drum has been described with reference to the tables of FIGS. 9A and 9B. However, it is not limited thereto. It is possible to provide a table in which the weak exposure amount and the normal exposure amount are increased non-linearly according to the integrated number of rotations of the photosensitive drum by taking the characteristic of the photosensitive drum into account.

The operation and effect of the flow chart of FIG. 7 will be described with reference to FIG. 8C. In the present exemplary embodiment, when the film thickness of the charge transport layer 24 of the photosensitive drum is 20 μm (photosensitive drum on the initial stage) when it is thickest and the charging potential Vd after the charging roller passes is approximately −600 V (see FIG. 3).

On the other hand, when the integrated number of rotations of the photosensitive drum is increased so that the film thickness of the charge transport layer 24 becomes thinner to 10 μm (photosensitive drum near the life expiration stage), the charging potential Vd becomes approximately −700 V, and the charging potential Vd is changed by approximately −100 V (see FIG. 3).

If a new photosensitive drum and a photosensitive drum near the life expiration stage are mixed or photosensitive drums having a different characteristic are mixed, a difference in the EV characteristic occurs among the photosensitive drums.

Because the charging potential Vd rises when the charge transport layer 24 becomes thin, the potential V1 after the exposure rises when the exposure amount of exposure for the image forming area is kept constant. Then, the exposure amount for full light emission is increased from E1 to E2 according to the integrated number of rotations of the photosensitive drum, which is inversely proportional to the film thickness of the charge transport layer 24. As illustrated with a solid line in FIGS. 8A, 8B, and 8C, the after-exposure potential V1 is kept substantially constant.

Therefore, the development contract Vcont (=Vdc−V1), which is a difference value between the development bias Vdc and the exposure potential V1, can be kept at a constant value regardless of the film thickness of the charge transport layer 24 of the photosensitive drum 1 to suppress generation of reduced image density.

As the value of the integrated number of rotations of the photosensitive drum is increased, the amount of laser beam for the exposure of the non-image forming area is increased from E1bg to E2bg. This has been already described with reference to the tables of FIGS. 9A and 9B.

Even when a DC voltage is applied to the charging rollers 2*a* to 2*d* at a predetermined value, a rise in the charging potential Vd generated due to a change in film thickness of the charge transport layer 24 of the photosensitive drum 1 can be corrected. Consequently, as illustrated with the solid line in FIGS. 8A, 8B, and 8C, the after-correction charging potential Vd_bg of the non-image forming area is kept substantially constant regardless of the film thickness of the charge transport layer 24.

Even if the developing voltage Vdc is kept at a constant value, the back contrast Vback, which is a potential difference between the developing potential Vdc and the after-correction charging potential Vd_bg, is kept constant. Consequently, the fogging, which occurs when not normally charged toner (in a case of reversal development, toner charged to 0 to positive polarity without turning to negative polarity) is transferred to the non-image forming area, can be suppressed.

Figures 10A, 10B:
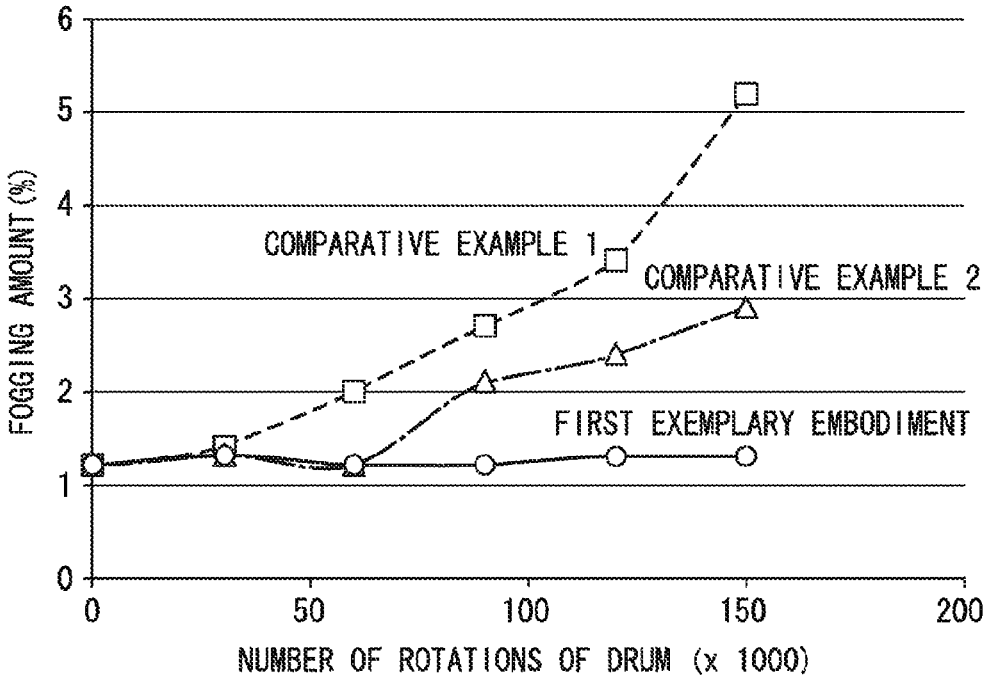
FIGS. 10A, 10B are diagrams illustrating an effect of a fogging amount and image uniformity.

FIGS. 10A and 10B illustrate changes in image quality evaluation according to comparative examples and a case where the weak exposure condition is changed under the aforementioned method. A case where no correction in the background area potential Vd for the weak exposure is executed both in FIG. 10A and FIG. 10B is designated as comparative example 1. Further, a case where the background area potential Vd is corrected with the charging potential Vcdc in the power supply circuit illustrated in FIGS. 5A and 5B is designated as comparative example 2.

FIG. 10A illustrates changes in the fogging amount. Because in the comparative example 1 of FIG. 10A, the charging potential Vd rises with an increase in the integrated number of rotations of the photosensitive drum, inverse fogging due to an increase in potential difference between the background area potential and the developing potential is deteriorated.

Although the inverse fogging is not deteriorated in the comparative example 2 in FIG. 10A, a local fogging occurs at an area having a low background area potential due to contamination of the charging roller, so that the total fogging amount tends to increase.

FIG. 10B illustrates changes in the image uniformity. In the comparative example 2, as the usage status of the photosensitive drum is progressed, the contamination of the charging roller is deteriorated thereby generating a spot image (phenomenon that the background area is partially developed because the background area potential drops below the developing bias) at a charging roller cycle.

Because the contamination of the charging roller is considered to be equivalent to that of a high resistance film on the surface, partial voltage at a small gap is reduced to obstruct discharging. Such a trend becomes more noticeable as the charging potential Vcdc is dropped. as a result, the correction of the background area potential Vb according to the comparative example 2 may cause deterioration of "spotted image", which is more noticeable than the "fogging".

According to the present exemplary embodiment, not only the charging potential (background area potential) can be kept constant to prevent deterioration of the inverse fogging, but also the exposure amount $E_0$ for the weak exposure is raised to secure a sufficient uniformity effect and form the background area potential without inviting any reduction in the uniformity of the charging potential due to contamination of the charging roller and the like. Therefore, an effective countermeasure can be taken to deal with a rise in the background area potential and a drop in uniformity accompanied by a progress of the usage.

Further, because the background area potential is kept constant in each image forming station, worsening of the fogging can be prevented even when a voltage is supplied from the same power supply to each developing unit.

In the first exemplary embodiment, the weak exposure for the non-image forming area when exposure based on image data is performed, is described. In a second exemplary embodiment, an example of the weak exposure control described above according to the first exemplary embodiment when adjusting the transfer voltage to be set at the transfer unit during a transfer operation (setting of the transfer voltage) will be described as another case of the weak exposure. In this transfer voltage control, the voltage setting during the transfer operation is adjusted based on a current flowing when a certain voltage is applied to the transfer unit.

Figure 11:
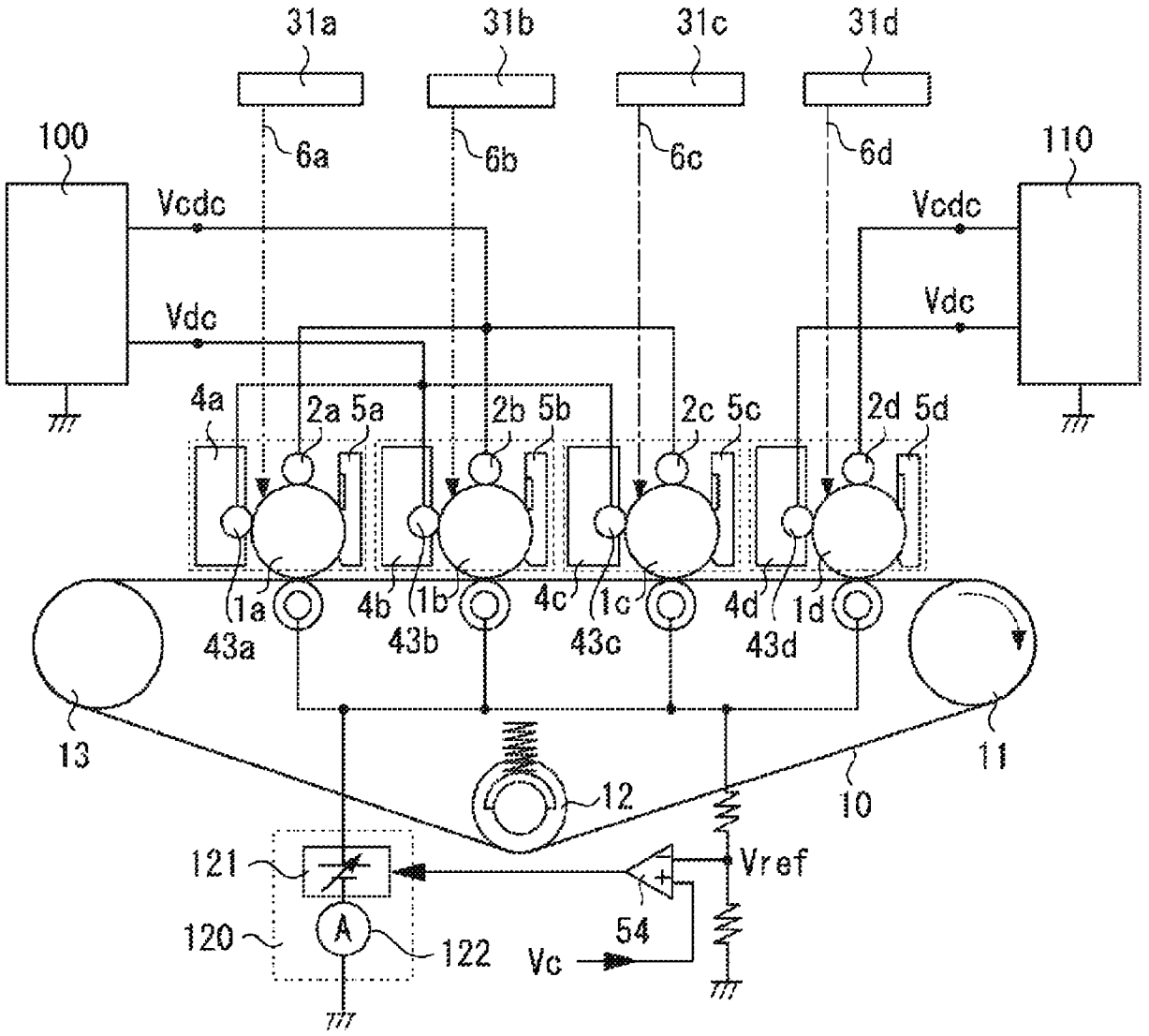
FIG. 11 is a diagram illustrating a high-voltage power supply for another charging unit and developing unit.

FIG. 11 is a diagram illustrating a high-voltage power supply for a charging unit and a developing unit different from those in FIG. 5. Referring to FIG. 11, the image forming apparatus illustrated in FIG. 5B is provided further with a transfer high-voltage power supply 120, which is a DC voltage power supply unit as a common power supply. Like in the first exemplary embodiment, a power supply voltage from the high-voltage power supply 120 or a conversion voltage obtained by converting the power supply voltage with a DC-DC converter can be supplied into the transfer rollers 14*a* to 14*d*.

Further, the power supply voltage or a voltage obtained by dividing or dropping the conversion voltage with an electronic device having a fixed voltage drop characteristic may be used. Because the same voltage is distributed to the transfer rollers 14*a* to 14*d* in the example illustrated in FIG. 11, a ratio of the distribution cannot be changed. The transfer high-voltage power supply 120 is constituted of a transformer and a transformer drive/control system 121 and a transfer current detection circuit 122.

The same reference numerals are attached to the same components as those in the first exemplary embodiment described above, and description thereof is omitted.

First, the transfer voltage control of the transfer unit will be described. A preparation operation (hereinafter referred to as preliminary rotation) performed prior to the image forming operation is executed under an instruction of the engine control unit 104 to detect an impedance value by summing up those of the transfer rollers 14*a* to 14*d* and the intermediate transfer belt 10.

Based on the obtained impedance, the engine control unit 104 calculates a voltage of the transformer 121 which cause a detection current Itr in the transfer current detection circuit 122 to be a predetermined value Itr0. The same processing is repeated to calculate a voltage of the transformer 121 which cause the detection current Itr to be the predetermined value Itr0 a plurality of times, and obtains an average voltage $V_0$ at that time.

A following transfer voltage control method is available as well as the impedance detection method. First, the engine control unit 104 sets an initial transfer voltage to detect a current at that time. When the detected current is lower than a target value, the engine control unit 104 resets the transfer voltage to a higher value, and when the detected current is higher than the target value, it resets the transfer voltage to a lower value.

Then, the engine control unit 104 performs processing of the above-described current detection and resetting of the transfer voltage based on the transfer voltage set by the engine control unit 104. This processing is repeated several times to obtain an appropriate transfer voltage setting. With this method also, an appropriate transfer voltage control can be performed.

In the subsequent image forming operation for visualizing the toner image, exposures for the non-image forming area and the image forming area are executed based on the image data like the above-described respective exemplary embodiments. After the toner image is developed on the photosensitive drums 1*a* to 1*d*, the average voltage $V_0$ calculated when performing the impedance detection of the preliminary rotation is applied to the transfer rollers 14*a* to 14*d*.

According to the present exemplary embodiment, in the detection of impedance of the transfer rollers 14*a* to 14*d* and the intermediate transfer belt 10, the charging potential of the photosensitive drums 1*a* to 1*d* is set to a specific value (Vd_bg) by the weak exposure at, for example, a timing of the preliminary rotation.

That is, the engine control unit 104 executes the similar processing as step S101 and step S103 in the flowchart of FIG. 7 described in the first exemplary embodiment, and causes the exposure unit to execute the weak light beam emission described referring to FIG. 6 according to the weak exposure amount parameter determined in step S103.

On the other hand, when the processing according to the flow chart described referring to FIG. 7 is not executed for the transfer voltage control executed at the preliminary rotation, a following problem occurs. That is, if the charge transport layer 24*a* to 24*d* of any of the photosensitive drums 1*a* to 1*d* has a different film thickness, variability in the surface potential can be generated on the photosensitive drums 1*a* to 1*d* by the exposure for the non-image forming area. This phenomenon has been already described in FIGS. 8A and 8B.

When steps S101 to S103 in the flow chart of FIG. 7 are executed in the transfer voltage control to be executed at the preliminary rotation, the surface potential of the photosensitive drums 1*a* to 1*d* can be kept constant by exposure for the non-image forming area. As a result, when detecting the impedance of the transfer rollers 1*a* to 1*d* at the preliminary rotation, the current detection circuit 122 can detect the current Itr under the same impedance condition (potential difference) to achieve the transfer voltage control (calibration) at a high accuracy.

According to the present exemplary embodiment, the potential difference between the transfer rollers 14*a* to 14*d* and the photosensitive drums 1*a* to 1*d* can be kept constant at the time of the transfer voltage control. Even when using the common transfer high-voltage power supply, the transfer voltage can be set at a high accuracy regardless of variability of the EV characteristic of the photosensitive drums 1*a* to 1*d*.

Consequently, generation of image defect caused by an insufficient transfer voltage during a transfer operation can be prevented. The transfer high-voltage power supply is used commonly for a plurality of colors, thereby contributing to reduction of the size of the image forming apparatus.

In the first exemplary embodiment, referring to FIG. 6, the engine control unit 104 sets the pulse width $PW_{MIN}$ (light-emitting time) to a short time according to an instruction of the weak exposure signals 68*a* to 68*d*, and executes the weak exposure for the background area where the toner image from is not to be visualized.

On the other hand, there can be another exemplary embodiment to obtain the same effect. For example, the laser diodes 63 may always execute the weak light beam emission to the background area where the toner image is not at least visualized.

In this case, the engine control unit 104 refers to the table illustrated in FIG. 12. Like in step S101 of FIG. 7, the engine control unit 104 acquires information about the integrated number of rotations of each photosensitive drum and refers to the luminance (mW) of a weak light beam emission corresponding to the acquired information.

Then, the engine control unit 104 issues an instruction (voltage value/signal) about the referred luminance (mW) for each weak exposure in a form of the weak exposure signals 68*a* to 68*d*.

Each of the laser drivers 62*a* to 62*d* always supplies a current to the laser diodes 63*a* to 63*d* according to an instructed luminance. At this time, the laser driver 62*a* does not execute the PWM laser light emission control for the weak exposure.

The engine control unit 104 refers to a summed luminance (mW) in the table of FIG. 12 based on information about the integrated number of rotations of each acquired photosensitive drum. Then, the engine control unit 104 issues an instruction (voltage value/signal) about the summed luminance referred to in a form of the luminance signals 61*a* to 61*d* described in FIG. 6.

In this case, the laser driver 62*a* includes an AND circuit. This AND circuit adds a PWM light emission value based on image data under an intensity (current) according to the summed luminance to the weak exposure light emission value based on an instructed intensity (current) to drive the laser diode 63*a*. As a result, the luminance for the normal exposure illustrated in FIG. 12 can be achieved. The PWM control according to the image data is a well-known technique, which will not be described in detail here.

Further, as further another exemplary embodiment, the weak exposure and the normal exposure may be executed with different circuits. In this case, the amount of exposure with respect to image data 0 in the normal exposure needs to be the same or substantially the same as that of the weak exposure. By executing the weak exposure at a weak luminance, an effect of reducing electronic noise can be achieved as well as the effects of the above-described exemplary embodiments.

As still another exemplary embodiment, the weak exposure signals 68*a* to 68*d* may be omitted, and an image signal conversion circuit may be provided in the upstream of the pulse width signals 60*a* to 60*d*, instead. More specifically, the image signal conversion circuit converts the image data to a gradation value 32 when the image data from the video controller 103 is a gradation value 0, and executes the weak light beam emission with the laser diode 63*a* at a rate of 32/255 with respect to the full light beam emission executed under a gradation value 255. When the gradation value is 1 to 255, the gradation value is converted to 33 to 255 by compression.

The gradation value after conversion when the image data is 0 may be changed to obtain a desired exposure amount corresponding to the service life illustrated in FIGS. 9A, 9B, and 12 in conjunction with the remaining service life of the photosensitive drum. If the gradation value after changing the gradation value to 0 is set to A not 32, the gradation value of image data 1 to 255 may be converted to (A+1) to 255 by compression.

In the above description, the video controller 103 and the engine control unit 104 are separated. However, the video controller 103 and the engine control unit 104 may be realized by the same single control unit. Alternatively, the function of the video controller 103 and the function of the engine control unit 104 may be included in the other one.

That is, it is expected that a variety of the control units is applied to each of the above-described exemplary embodiments. For example, the pulse width signals 60*a* to 60*d* may be generated by the video controller 103 and then, the video controller 103 may directly control the laser scanner system serving as an exposure unit via the engine control unit 104.

In the above description, the high-voltage power supplies for the charging unit and the developing unit are commonalized with a single power supply (corresponding to the transformer 53) in FIGS. 5A and 5B. However, the configuration in the above description is effective for a case where no independent power supply control can be applied between different colors for charging, and no independent power supply control can be applied between the different colors for development also, as is evident from the description based on FIGS. 8A and 8B.

Therefore, a single power supply (corresponding to a single transformer) for charging a plurality of units and a single power supply (corresponding to a single transformer) for developing a plurality of units. In the meantime, the respective power supplies are distinguished as a first power supply and a second power supply.

Then, in this case, a voltage (first power supply voltage) output from the charging power supply or a voltage (first conversion voltage) obtained by conversion with a converter is input to the charging rollers 2*a* to 2*d*.

On the other hand, a voltage (second power supply voltage) output from the developing power supply or a voltage (second conversion voltage) obtained by conversion with the converter is input to the developing rollers 43*a* to 43*d*.

As described with reference to FIGS. 5A and 5B, a voltage input to individual rollers (charging roller or developing roller) can be applied to a variety of variability.

For example, the power supply voltage (a first power supply voltage, a second power supply voltage) of the single power supply (first and second power supplies) or the voltage (a first conversion voltage, a second conversion voltage) obtained by conversion with the converter may be divided or dropped with an electronic device having a fixed voltage drop characteristic. Then, those voltages (first voltage, second voltage) may be input to the charging rollers 2*a* to 2*d* and the developing rollers 43*a* to 43*d*.

In the above description, the electronic device having the fixed voltage drop characteristic is used to drop/raise the voltage. However, the processing by the weak exposure according to the flow chart of FIG. 7 is effective for a case where a DC-DC converter having a particular function is provided for each charging roller and developing roller.

Figure 8C:
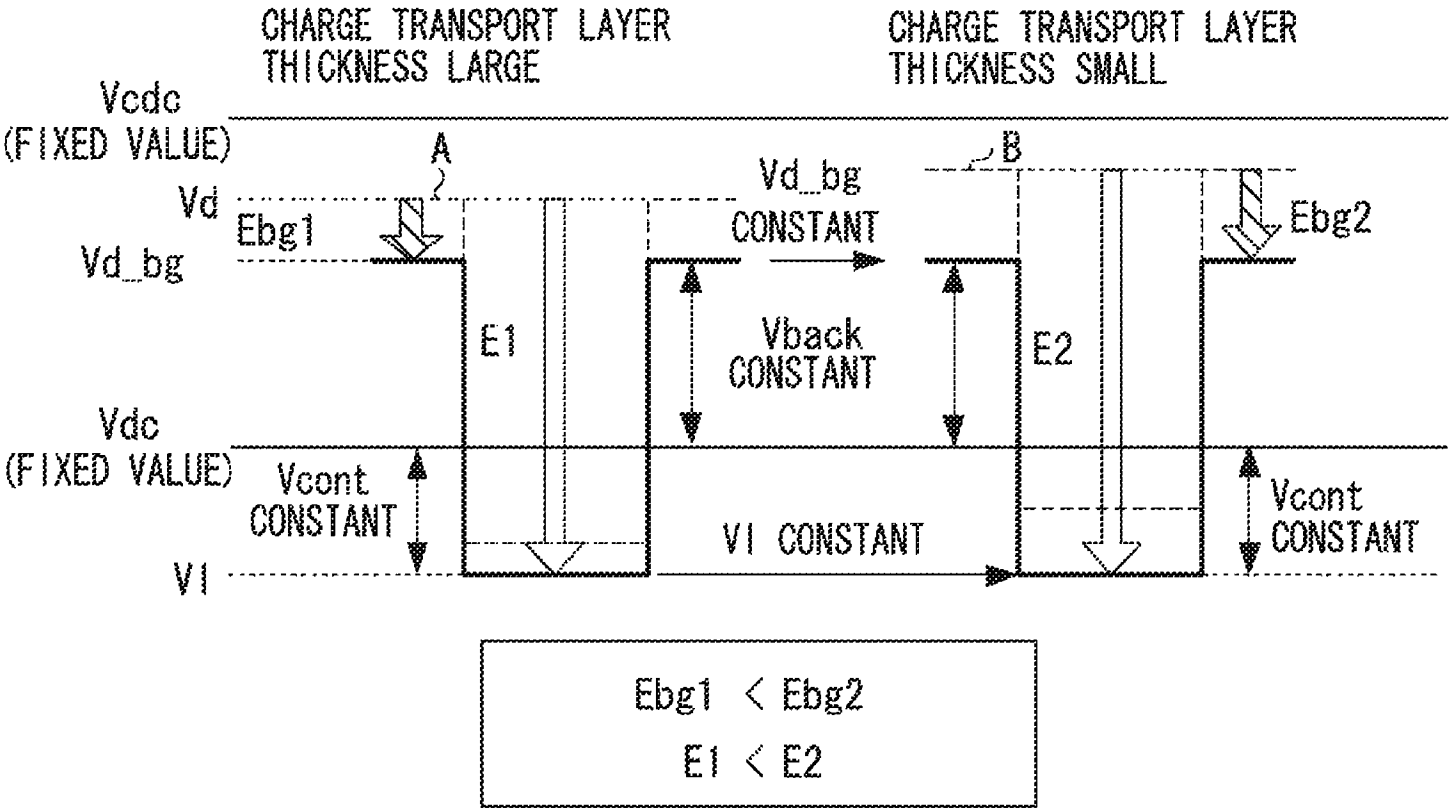

That is, if the voltage conversion capacity of the DC-DC converter is insufficient when the state illustrated in FIG. 8A occurs, a potential Vd_bg illustrated in FIG. 8C cannot be realized with the voltage conversion capacity alone. In such a case, potential formation, which is insufficient for the DC-DC converter, may be compensated by the weak exposure processing to achieve the charging potential Vd_bg.

Further, in the description referring to FIG. 7, the parameter for the weak exposure and the parameter for the normal exposure are set according to information (information concerning the sensitivity characteristic of the drum) concerning the remaining service life of the photosensitive member. The parameters are the value of the weak exposure signal 68*a* configured to instruct a pulse width in the weak exposure and the value of the weak exposure signal 68*a* configured to instruct a light-emission intensity. The same thing can be said of the normal exposure.

Further, the correction may be performed on the parameters according to the environment (temperature and humidity) within the image forming apparatus main body and to changes with a passage of time of the image forming apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A color image forming apparatus including photosensitive members, charging units configured to charge the photosensitive members, light emission units configured to form an electrostatic latent image on the photosensitive member charged by being irradiated with light, and developing units configured to visualize a toner image by applying toner to the electrostatic latent image, corresponding to a plurality of colors, respectively, the color image forming apparatus comprising:

a plurality of storage units corresponded to the plurality of colors, wherein information concerning a remaining service life of each of the plurality of photosensitive members corresponding to the plurality of colors is stored in each of the plurality of storage units, an acquisition unit configured to acquire information concerning a remaining service life of each of the plurality of photosensitive members; and a control unit configured to cause each of the plurality of the light emission units to execute normal light emission for visualizing the toner image onto an area where the toner image is to be visualized on the charged photosensitive member, and cause the plurality of light emission units to execute weak light emission onto a background area where the toner image is not to be visualized on the charged photosensitive member, the control unit controls the plurality of light emission units so that an exposure amount of the photosensitive members by executing the normal light emission is larger than an exposure amount of the photosensitive members by executing the weak light emission, wherein the control unit changes the amount of light for weak light emission by each of the plurality of the light emission units based on information concerning the remaining service life of each of the photosensitive member acquired by the acquisition unit.

2. The color image forming apparatus according to claim 1, wherein the control unit changes the amount of light for the normal light emission by each of the plurality of the light emission units based on information concerning the remaining service life of each of the photosensitive members acquired by the acquisition unit.

3. The color image forming apparatus according to claim 1, wherein the control for changing the amount of light for the weak light emission is executed by correcting the pulse width which determines a laser light-emitting time or correcting a laser luminance.

4. The color image forming apparatus according to claim 2, wherein the control for changing the amount of light for the normal light emission is executed by correcting the laser luminance.

5. The color image forming apparatus according to claim 1, wherein the control unit causes the plurality of light emission units to execute the normal light emission, in which an amount of light based on image data input from outside is added to the amount of light for the weak light emission, to an area where a toner image is to be visualized on the charged photosensitive member.

6. The color image forming apparatus according to claim 1, wherein the plurality of charging units and/or the plurality of developing units corresponding to the plurality of colors are supplied with a voltage obtained by dividing and/or dropping a power supply voltage supplied from a power supply or a conversion voltage obtained by converting the power supply voltage with a converter, with an electronic device having a fixed voltage drop characteristic.

7. The color image forming apparatus according to claim 1, further comprising a single power supply, wherein a power supply voltage output from the single power supply, a conversion voltage obtained by converting the power supply voltage with the converter, or a voltage obtained by dividing and/or dropping the power supply voltage or the conversion voltage with the device having the fixed voltage drop characteristic is input to the plurality of charging units, and the conversion voltage obtained by converting the power supply voltage with the converter or the voltage obtained by dividing and/or dropping the power supply voltage or the conversion voltage with the device having the fixed voltage drop characteristic is input to the plurality of developing units.

8. The color image forming apparatus according to claim 1, further comprising a first power supply and a second power supply, wherein a first power supply voltage output from the first power supply, a first conversion voltage obtained by converting the first power supply voltage with the converter, or a first voltage obtained by dividing or dropping the first power supply voltage or the first conversion voltage with the device having the fixed voltage drop characteristic is input to the plurality of the charging units, and wherein a second power supply voltage output from the second power supply, a second conversion voltage obtained by converting the second power supply voltage with the converter, or a second voltage obtained by dividing or dropping the second power supply voltage or the second conversion voltage with the device having the fixed voltage drop characteristic is input to the plurality of the developing units.

9. The color image forming apparatus according to claim 1, further comprising a plurality of transfer units corresponding to the plurality of colors, wherein the plurality of transfer units are supplied with a voltage obtained by diving or dropping the power supply voltage from the power supply or a conversion voltage obtained by converting the power supply voltage with the converter, with the device having the fixed voltage drop characteristic, wherein the control unit executes transfer voltage control of adjusting a voltage setting during a transfer operation based on a current flowing when the transfer voltage is set in the transfer unit, and when the transfer voltage is controlled, changes the amount of light for the weak light emission.

10. The color image forming apparatus according to claim 1, wherein the control unit is configured to increase the amount of light for the weak light emission by each of the plurality of light emission units as remaining service life of each of the plurality of photosensitive members is increased.

11. The color image forming apparatus according to claim 1, wherein information concerning a remaining service life of each of the plurality of photosensitive members is information of an integrated number of rotations of each of the plurality of photosensitive members.

12. The color image forming apparatus according to claim 1, further comprising:

a plurality of cartridges corresponding to the plurality of colors, wherein each of the plurality of cartridges includes a photosensitive member and is detachable with respect to the image forming apparatus, and wherein each of the plurality of cartridges includes the storage unit.

* * * * *